US011280164B2

(12) United States Patent
Wessling

(10) Patent No.: US 11,280,164 B2
(45) Date of Patent: Mar. 22, 2022

(54) REAL TIME PRODUCTIVITY EVALUATION OF LATERAL WELLS FOR CONSTRUCTION DECISIONS

(71) Applicant: Baker Hughes Oilfield Operations LLC, Houston, TX (US)

(72) Inventor: Stefan Wessling, Hannover (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 65 days.

(21) Appl. No.: 16/820,938

(22) Filed: Mar. 17, 2020

(65) Prior Publication Data

US 2020/0308936 A1 Oct. 1, 2020

Related U.S. Application Data

(60) Provisional application No. 62/827,741, filed on Apr. 1, 2019.

(51) Int. Cl.
*E21B 41/00* (2006.01)
*E21B 49/00* (2006.01)

(52) U.S. Cl.
CPC ..... *E21B 41/0092* (2013.01); *E21B 49/003* (2013.01)

(58) Field of Classification Search
None
See application file for complete search history.

(56) References Cited

U.S. PATENT DOCUMENTS 6,283,210 B1 * 9/2001 Soliman ..... E21B 33/138 166/270
2006/0095240 A1 * 5/2006 Elisabeth ..... E21B 47/09 703/10
2011/0290479 A1 * 12/2011 Izgec ..... E21B 43/16 166/250.02
2013/0132052 A1 * 5/2013 Hogg ..... G06T 17/05 703/6
2016/0312585 A1 * 10/2016 Filippov ..... E21B 43/12
2017/0205531 A1 * 7/2017 Berard ..... E21B 47/002
2019/0368994 A1 * 12/2019 Al Readean ..... G01N 15/08

OTHER PUBLICATIONS

Riazi, Zahra. (2017). Application of integrated rock typing and flow units identification methods for an Iranian carbonate reservoir. Journal of Petroleum Science and Engineering. 160. 10.1016/j.petrol.2017.10.025 (Year: 2017).*

Anyiam , et al., The Use of Lorenz Coefficient in the Reservoir Heterogeneity Study of a Field in the Coastal Swamp, Niger Delta, Nigeria. Petroleum and Coal. Mar. 9, 2018, 60(4), pp. 560-568.

* cited by examiner

*Primary Examiner* — Lina M Cordero
(74) *Attorney, Agent, or Firm* — Mintz Levin Cohn Ferris Glovsky and Popeo, PC; Lisa Adams

(57) ABSTRACT

In an aspect, a method includes receiving data characterizing measurements recorded while drilling a wellbore. The method can also include determining, using the measurements and a reservoir map, a storage capacity of the wellbore and a flow capacity of the wellbore. The method can further include determining a well construction plan using the storage capacity and the flow capacity. The method can also include providing the well construction plan. Related systems, techniques, and non-transitory computer readable mediums are also described.

20 Claims, 19 Drawing Sheets

| MO | Ine | Azi | Bur | WR | DLS |
|---|---|---|---|---|---|
| 9634 | 90 | 215.84 | 0 | 4.06 | 4.07 |
| 9635 | 90 | 215.89 | 0 | 4.26 | 4.27 |
| 9636 | 90 | 215.96 | 0 | 4.47 | 4.47 |
| 9637 | 90 | 216.03 | 0 | 4.63 | 4.63 |
| 9638 | 89.91 | 216.08 | -0.1 | 4.7 | 4.71 |
| 9639 | 90 | 216.1 | -0.1 | 4.7 | 4.71 |
| 9640 | 89.92 | 216.11 | -0.17 | 4.6 | 4.61 |
| 9641 | 90 | 216.11 | -0.08 | 4.44 | 4.44 |
| 9642 | 89.93 | 216.11 | -0.08 | 4.38 | 4.38 |
| 9643 | 90 | 216.11 | 0 | 4.37 | 4.37 |
| 9644 | 90 | 216.11 | 0 | 4.31 | 4.31 |
| 9645 | 89.91 | 216.07 | 0 | 4.06 | 4.06 |
| 9646 | 89.91 | 215.99 | 0 | 3.62 | 3.62 |
| 9647 | 90 | 215.97 | 0 | 3.06 | 3.06 |
| 9648 | 89.93 | 215.97 | -0.1 | 2.72 | 2.73 |
| 9649 | 89.91 | 215.97 | -0.13 | 2.53 | 2.54 |
| 9650 | 89.91 | 215.96 | -0.14 | 2.49 | 2.5 |
| 9651 | 89.97 | 215.96 | -0.14 | 2.48 | 2.49 |
| 9652 | 90 | 215.97 | -0.14 | 2.48 | 2.48 |
| 9653 | 90 | 215.97 | -0.14 | 2.46 | 2.47 |
| 9654 | 89.91 | 215.97 | -0.2 | 2.45 | 2.46 |
| 9655 | 89.91 | 215.97 | -0.3 | 2.34 | 2.36 |
| 9656 | 89.91 | 215.97 | -0.3 | 2.2 | 2.21 |

REAL TIME PRODUCTIVITY EVALUATION OF LATERAL WELLS FOR CONSTRUCTION DECISIONS

RELATED APPLICATION

This application claims priority under 35 U.S.C. § 119(e) to U.S. Provisional Application No. 62/827,741, filed Apr. 1, 2019, the entire contents of which are hereby expressly incorporated by reference herein.

BACKGROUND

Drilling a wellbore can include drilling a hole in the ground, for example, to extract a natural resource such as ground water, natural gas, or petroleum. A wellbore can also be drilled to inject a fluid from the surface to a subsurface reservoir, or for subsurface formations evaluation or monitoring. Access to the reservoir through the wellbore can be prevented in some cases.

SUMMARY

In an aspect, a method includes receiving data characterizing measurements recorded while drilling a wellbore. The method can also include determining, using the measurements and a reservoir map, a storage capacity of the wellbore and a flow capacity of the wellbore. The method can further include determining, using the storage capacity and the flow capacity, a well construction plan. The method can also include providing the well construction plan.

One or more of the following features can be combined in any feasible combination. For example, determining the well construction plan can further include determining, using the flow capacity, a first placement location for an inflow control device. The method of providing the well construction plan can further include providing, within the graphical user interface display space, the first placement location. The measurements can include a hole quality measurement. The method of determining the well construction plan can further include determining, using the hole quality measurement, a second placement location for a packer. The method of providing the well construction plan can further include providing, within the graphical user interface display space, the second placement location.

The method can also include plotting the flow capacity as a function of the storage capacity. The method can further include determining a first zone of the plot and a second zone of the plot. The first zone can include a first portion of the plot with a first slope and the second zone including a second portion of the plot with a second slope. The method can also include sorting the first zone and the second zone using the first slope and the second slope. The method can further include providing the sorted first zone and second zone in a graphical user interface display space. The first slope can characterize the first zone with a first quality representing satisfactory production, early breakthrough, and/or flow restriction.

The method can also include receiving data characterizing a first slope threshold value. The method can further include comparing the first slope to the first slope threshold value and determining the first zone can be characterized by a first quality. The method can also include providing, within the graphical user interface display space, the characterization of the first zone with the first quality. The second slope can characterize the second zone with a second quality representing unsatisfactory production, unsatisfactory recovery, and/or requiring treatment. The treatment can include stimulation, cementation, and/or zone isolation. The plot can include a stratigraphic modified Lorenz plot and/or an associated modified Lorenz plot.

The method can also include providing, within the graphical user interface display space, a visualization of a reservoir mapping, a near-wellbore structural model, an image of fractures around the wellbore, an SLS, a gas ratio saturation, a micro-particle performance rating, and/or a neutron density measurement. The image of fractures around the wellbore can further include a density, a resistivity, a gamma ray, and/or an acoustic impedance. The well construction plan can include wellbore positioning data and wellbore navigation data.

Non-transitory computer program products (i.e., physically embodied computer program products) are also described that store instructions, which when executed by one or more data processors of one or more computing systems, causes at least one data processor to perform operations herein. Similarly, computer systems are also described that may include one or more data processors and memory coupled to the one or more data processors. The memory may temporarily or permanently store instructions that cause at least one processor to perform one or more of the operations described herein. In addition, methods can be implemented by one or more data processors either within a single computing system or distributed among two or more computing systems. Such computing systems can be connected and can exchange data and/or commands or other instructions or the like via one or more connections, including a connection over a network (e.g. the Internet, a wireless wide area network, a local area network, a wide area network, a wired network, or the like), via a direct connection between one or more of the multiple computing systems, etc.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

Like reference symbols in the various drawings indicate like elements.

DETAILED DESCRIPTION

Figure 1:
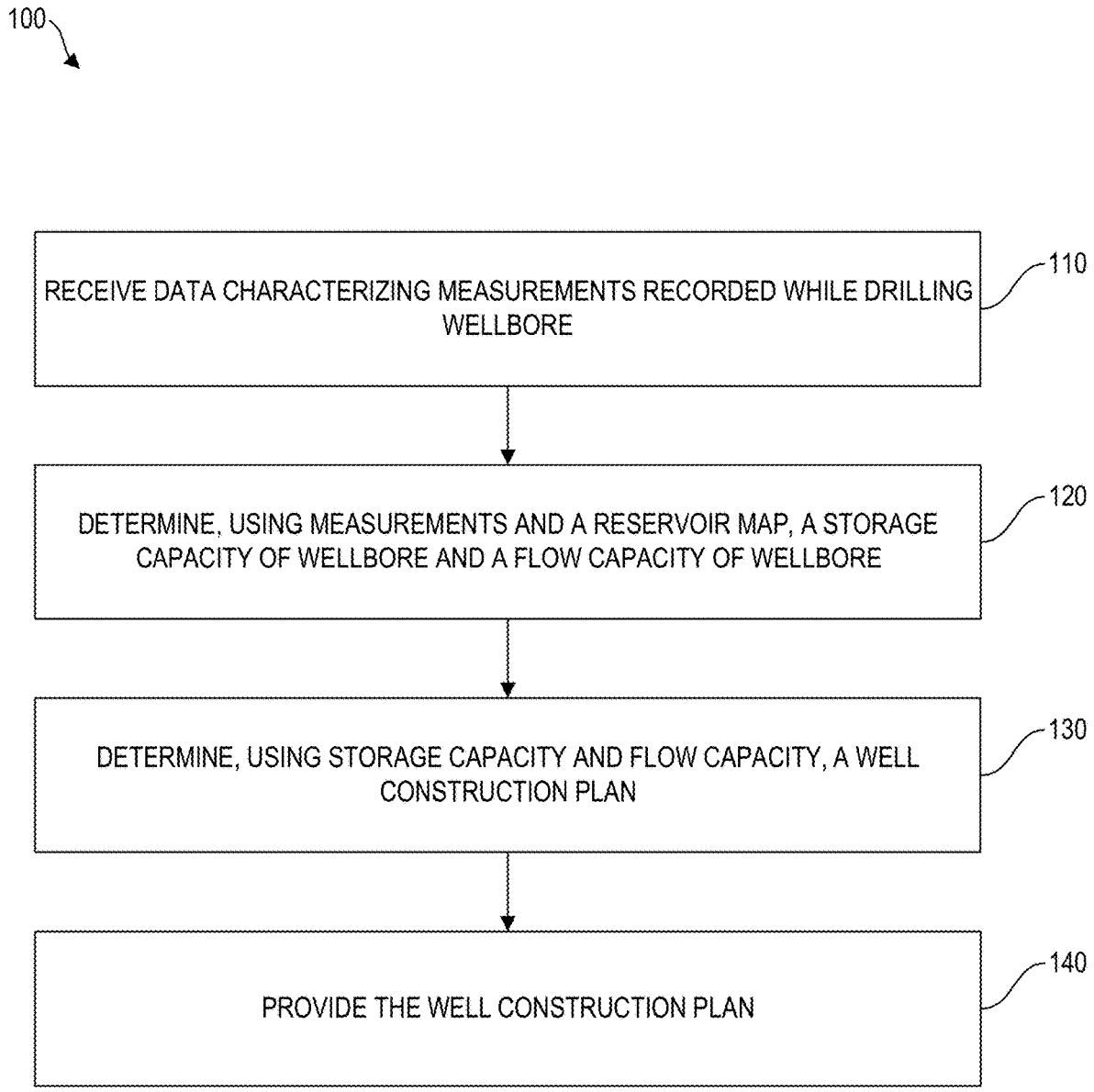
FIG. 1 illustrates an example process for determining a well construction plan.

Oil and gas operations can include well construction, completion, and production. Well construction can include drilling a wellbore and well completion can include making the wellbore ready for production. For example, lower-completion equipment to connect the reservoir can include screens to prevent from excessive sand production, blanks to disconnect a section of the wellbore from the surrounding formation, in-flow control devices to control and/or restrict the influx of fluid from a formation interval into the wellbore, packers to isolate sections along the wellbore from each other, and/or the like. In general, open-hole completion or cased-hole completion can be utilized for well construction. Open-hole completion can be cost-efficient but can allow limited workover and wellbore control throughout the lifecycle of the well. Cased-hole completion can be more expensive, but can allow well treatment operations such as perforation, fracturing and/or stimulation to optimize recovery of the reservoir over the well lifecycle.

But poor wellbore hole quality can present challenges to well completion. For example, inferior hole quality can prevent running a completion string to the expected total depth of the well. In some cases, a packer can be used to provide a seal between the outside of the production tubing and the inside of the casing, liner, and/or wellbore wall. And in wells with multiple production zones, packers can be used to isolate the perforations for each zone. But zone isolation can be challenging due to, for example, poor packer sealing by an excessively large hole diameter, poor cementation quality due to mud displacement, eccentricity of the casing string, and/or the like. Another example of a completion challenge can include the damaging of a completion screen due to running the screen through a section of the wellbore with excessive dogleg severity. As an example, a screen can be exposed to a maximum dogleg severity of 3 degrees per 100 ft, so that an exposure above that threshold has a risk of sand production.

Similarly, poor reservoir quality can present challenges to well production. For example, coning at a reservoir heel can cause unequal reservoir depletion along a lateral well. In some cases, an in-flow control device can be used to restrict flow between the different zones of the well. But reservoir quality, such as at the near wellbore area, can also be impacted by damage due to drilling and/or completion/displacement fluids. And assessing reservoir quality during construction can be cumbersome. For example, reservoir quality by matching production data against historical data and/or models can be determined after a substantial amount of time and can be inaccurate. In some cases, mismatches between expected production key performance indicators (KPI's) and the actual production can lead to an adjustment of business and/or revenue assumptions which can have consequences on jurisdiction and trading for an operator of a hydrocarbon field. Early evaluation of production KPI's and early understanding of risk associated with production challenges due to well construction constraints can be desirable to avoid, for example, penalties and/or other consequences later during hydrocarbon production of a wellbore.

Some implementations of the current subject matter can determine a well construction plan for a wellbore by evaluating wellbore hole and reservoir quality by using a thickness of the drilled reservoir determined from the reservoir map. For example, the well construction plan can include wellbore positioning, wellbore navigation, and/or a placement location for a packer and/or an in-flow control device. Hole quality can be evaluated, for example, by calculating dogleg severity from stationary surveys taken at every stand of the drill pipe, continuous inclination, and/or azimuthal measurements using accelerometers and magnetometers in a bottom-hole-assembly. Measurements collected at the bottom-hole-assembly can provide a well path, for example, with a higher resolution compared to measurements collected at stands of the drill pipe.

Hole quality characterization can also be conducted by other sensors and measurement principles such as an ultrasonic measurements, measurements of the density surrounding a formation, gamma measurements, and/or the like. Ultrasonic measurements detect a reflection of an ultrasonic wave from the borehole wall and acquiring the reflection azimuthally results in a 3-dimensional scanning of the hole shape. For simplicity, the hole shape can be plotted as a 2-dimensional image of the borehole wall with color-coded representation of the diameter or radius of the wellbore. Another measure for hole quality can be provided by acquiring an azimuthal representation of the formation density detected by a near-field and a far-field detector, respectively. The near-field detector can be more sensitive to the near wellbore environment (e.g., hole size, mud, cuttings, and/or the like) compared to the far-field detector, so that the difference in density readings between these sensors provides additional indicators for the shape of a wellbore. Yet another alternative way to characterize hole shape includes repeat-log measurements of, for example, gamma ray readings. Gamma ray readings can be affected by the environment of the wellbore, so that changes in borehole size in between two measurement cycles over time will decrease or increase the gamma ray reading, depending on the wellbore environmental conditions.

Reservoir quality can be evaluated, for example, by determining flow and/or storage capacity of a reservoir using physical properties determined using reservoir mapping, such as the thickness of the drilled reservoir. By evaluating wellbore hole and reservoir quality using, for example, the thickness of the drilled reservoir determined from the reservoir map and by determining a well construction plan using the wellbore hole and reservoir quality evaluation, well completion and production efficiency can be improved.

FIG. 1 is a process flow diagram illustrating an example method of determining a well construction plan. The method can be performed to evaluate a wellbore hole and reservoir quality by, for example, determining flow and/or storage capacity of a reservoir using physical properties determined using reservoir mapping, such as the thickness of the drilled reservoir. By evaluating wellbore hole and reservoir quality using, for example, the thickness of the drilled reservoir determined from the reservoir map and determining a well construction plan using the wellbore hole and reservoir quality evaluation, well completion and production efficiency can be improved.

At 110, data characterizing measurements recorded while drilling a wellbore can be received. For example, the received measurements can include resistivity, density, porosity, permeability, acoustic properties, nuclear-magnetic resonance properties, formation pressures, properties or characteristics of the fluids and reservoir conditions (pressure) downhole and other desired properties of the formation surrounding the wellbore. The received measurements can be received, for example, from sensors, downhole tools, and/or the like deployed before, during, and/or after drilling. For example, the sensors can be deployed via wireline, measurement while drilling, and/or logging while drilling components. The measurements can be received by at least one processor forming part of at least one computing system.

At 120, the storage capacity of the wellbore and the flow capacity of the wellbore can be determined using the measurements. For example, given a measured depth (MD) z, a porosity Φ, and a thickness, th, of the drilled reservoir determined using the reservoir map, storage capacity can be determined as follows:

$$\text{storage}\ (z_m) = \frac{\sum_{i=1}^{m} \Phi_i th_i (z_i - z_{i-1})}{\sum_{j=1}^{N} \Phi_j th_j (z_j - z_{j-1})},$$

for 1, . . . , m, . . . N.

In some embodiments, the thickness of a reservoir can be determined using electromagnetic measurement principles, which exhibit a depth of detection of formation changes at greater depth away from the wellbore. Formation changes can include a contrast in electrical conductivity between a caprock (e.g., shale) and a sandstone reservoir (e.g., sand), with a shale commonly exhibiting much higher electrical conductivities compared to hydro-carbon-filled sandstones. Some embodiments can include the detection of an electrical conductivity contrast between hydrocarbons (e.g., low electrical conductivity) and formation water (e.g., high electrical conductivity due to the high salinity content). The interpretation of electromagnetic deep-reading measurements, such as an azimuthal measurement of the signal strength can thus provide a means to detect the distance and orientation of a change in conductivity contrast from which the extent of a reservoir can be inferred. For example, forward and/or inversion algorithms can be applied to the azimuthal and/or omnidirectional measurements to create a model for the resistivity or conductivity distribution around a borehole (e.g., resistivity map). That map can then be used to define an extent of a reservoir by delineating the resistivity contrasts from the map. Such maps can be represented as curtain sections along a well trajectory and can include a 3-dimensional representation of resistivity and/or conductivity values around a wellbore from which the extent of a reservoir can be inferred.

In some embodiments, a reservoir map can be provided by a digital model. The model can be adjusted, for example, automatically and/or manually, to match desired geological perceptions and/or to derive an Earth model which is able to explain formation measurements using appropriate formation response modeling algorithms and/or formulae. The digital model can be, for example 1-dimensional, 2-dimensional, and/or 3-dimensional, and geological features within that model, such as geological boundaries, beddings, faults, fluid contacts, and/or the like can be represented by, for example, mathematical polygons and/or other parametric representations of a geometrical body of any extent.

In some embodiments, acoustic reflection measurements can be used to delineate the extent of a reservoir. Such measurements include exciting an acoustic wave from the wellbore into the formation using appropriate acoustic sources, and detecting an acoustic signal by a number of receivers, with the signals arising from a reflected wave at a formation boundary with sufficiently high acoustic impedance contrast. Those boundaries can likewise be used to define reservoir thickness. In yet another embodiment, the reservoir thickness can be delineated from seismic data, which can have been acquired at surface, seafloor, within a wellbore (e.g., vertical seismic profiling and/or the like), and/or the like. Similarly, given a measured depth z, a permeability K, flow capacity can be determined as follows:

$$\text{flow}\ (z_m) = \frac{\sum_{i=1}^{m} K_i (z_i - z_{i-1})}{\sum_{j=1}^{N} K_j (z_j - z_{j-1})},$$

for 1, . . . , m, . . . N.

At 130, a well construction plan can be determined using the storage capacity and the flow capacity. A well construction plan can include an ordered arrangement by which zones in the reservoir can be completed. For example, given a well depletion strategy such as recovery oriented well completion, the well construction plan can include completing the less productive zones prior to connecting (e.g., through well construction) zones with higher productivity. As shown above, productivity can be determined by using, for example, storage capacity, flow capacity, and/or the like. A less productive zone can include a zone with a lower flow capacity than another zone, whereas the storage capacity of that zone indicates the relative amount of hydrocarbons stored in that particular zone relative to the rest of the reservoir along a lateral well.

For example, a first zone can include a first flow capacity and a second zone can include a second flow capacity. The first zone can be less productive than the second zone if, for example, the flow capacity of the first zone is less than the flow capacity of the second zone. A recovery oriented well completion strategy can include a well construction plan indicating completion of the first zone (e.g., the less productive zone) before connecting zone 2 (e.g., the more productive zone). As will be discussed below, the well construction plan can include geo-stopping, reservoir navigation services, hole quality enhancement (e.g., reaming, and/or the like), treatments (e.g., stimulation, cementation, zone isolation, and/or the like), and/or the like.

At 140, the well construction plan can be provided. The well construction plan can be provided on a display space of a graphical user interface of the at least one computing system. In one embodiment, a well construction plan can include displaying the well trajectory and available or useful data within a curtain section, and in addition plotting a dedicated track with a completion scheme visible. For example, the completion scheme can include packers, blanks and screens and the track will display the start and end depths of the individual equipment. The equipment can also be visualized in an advanced way, such as being displayed within a 3D subsurface environment around a tube.

It can be desirable to determine the quality of a wellbore. For example, hole quality can provide an indication of the performance of a wellbore, and determining the quality of a wellbore can include determining the hole quality. For example, indicators of poor hole quality, such as ledges, hole rugosity, high doglegs, and/or the like can prevent running the completion string to the expected total depth. If the completion string cannot run to the expected total depth, hydrocarbon may not be accessible by the drilled wellbore. Accordingly, poor hole quality can result in poor wellbore quality.

The usage of screens as lower completion equipment, for example, for sand control can dictate a strict maximum dogleg severity, such as a maximum of 3 degrees over 100 feet. But more long-term control can be desired, for example, due to expected gas and/or water production, handling incompetent formations, and/or the like. In such cases, lateral wells can be cemented and/or selectively treated, perforated, and/or the like, and/or open-hole packers can be placed within the lateral well for the isolation of zones from each other.

Figure 2:
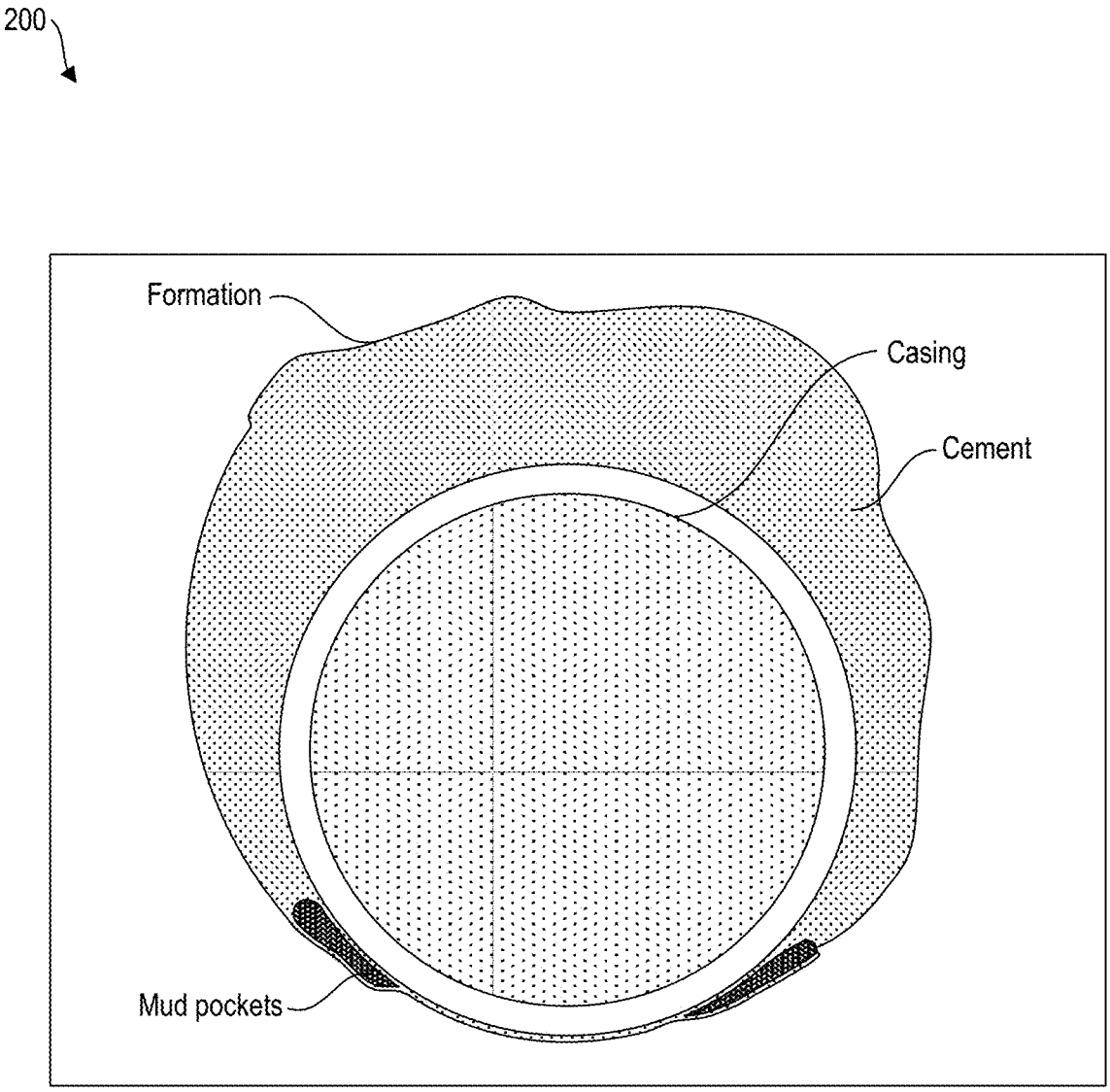
FIG. 2 is a diagram illustrating poor cementation quality.

FIG. 2 is a diagram 200 illustrating poor cementation quality. In some instances, zone isolation can be unsatisfactory. For example, zone isolation can be unsatisfactory due to poor packer sealing, poor cementation quality due to inappropriate mud displacement (e.g., leaving mud pockets at the low side of a lateral well), cement slumping (e.g., leaving voids at the high side of a lateral well), eccentricity of the casing string, and/or the like.

Figure 3:
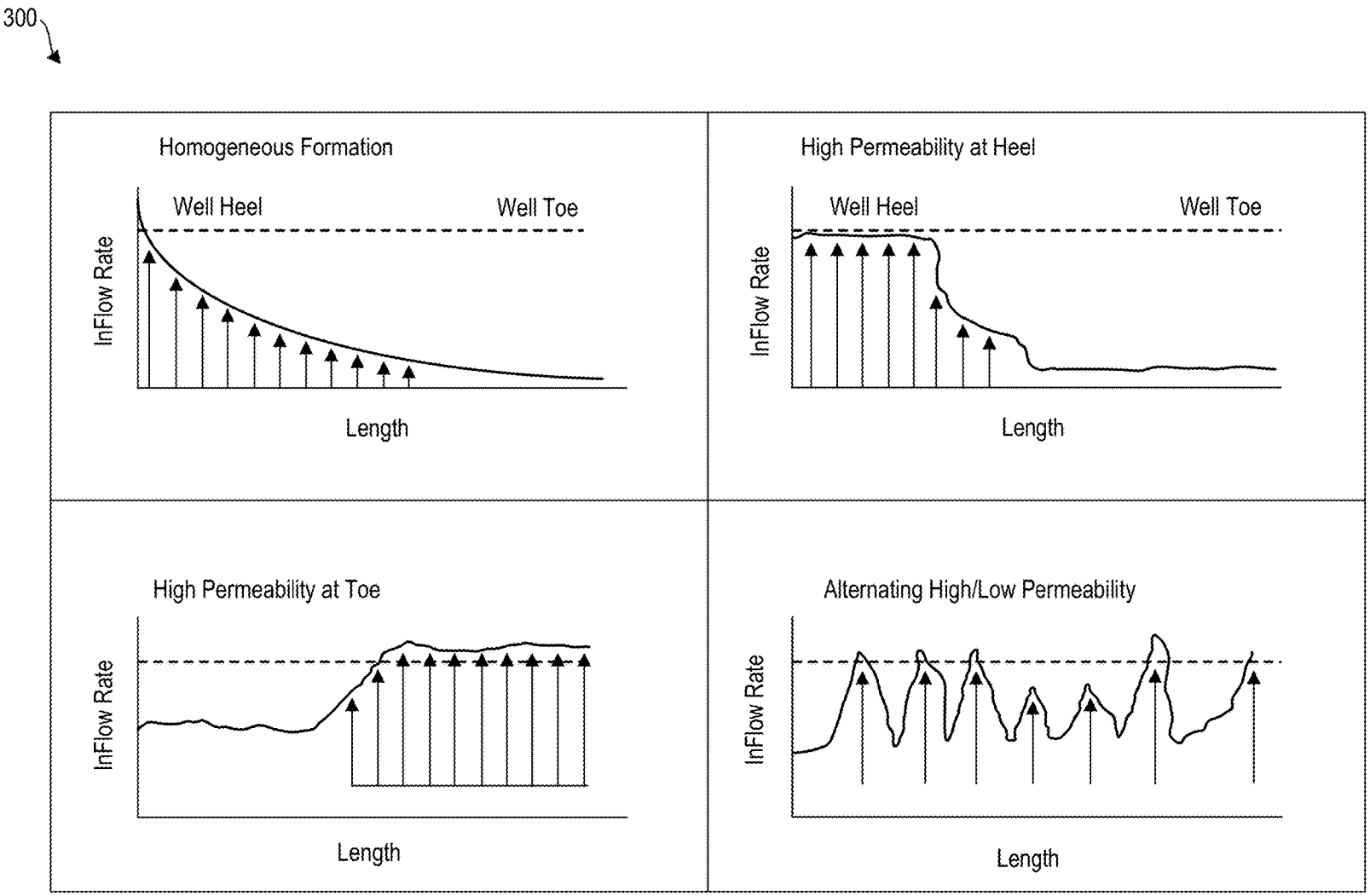
FIG. 3 is a diagram illustrating example inflow patterns for different reservoir characteristics along a lateral well.

Similarly, it can be desirable to determine the quality of a reservoir. For example, reservoir quality can provide an indicator of reservoir production and can provide a framework for reservoir navigation, well placement, and/or the like. As discussed above, production from a wellbore can depend on the quality of the reservoir. FIG. 3 is a diagram 300 illustrating four plots of example inflow patterns and corresponding reservoir characteristics as measured along a length of a lateral well. Reservoir characteristics can include, for example, homogeneous formation, high permeability at heel, high permeability at toe, alternating high/low permeability, and/or the like. As illustrated in each of the plots of FIG. 3, the inflow rate, shown on the Y-axis in each plot, as a function of well length, shown on the X axis of each plot, can indicate the productivity of the reservoir.

Figure 4:
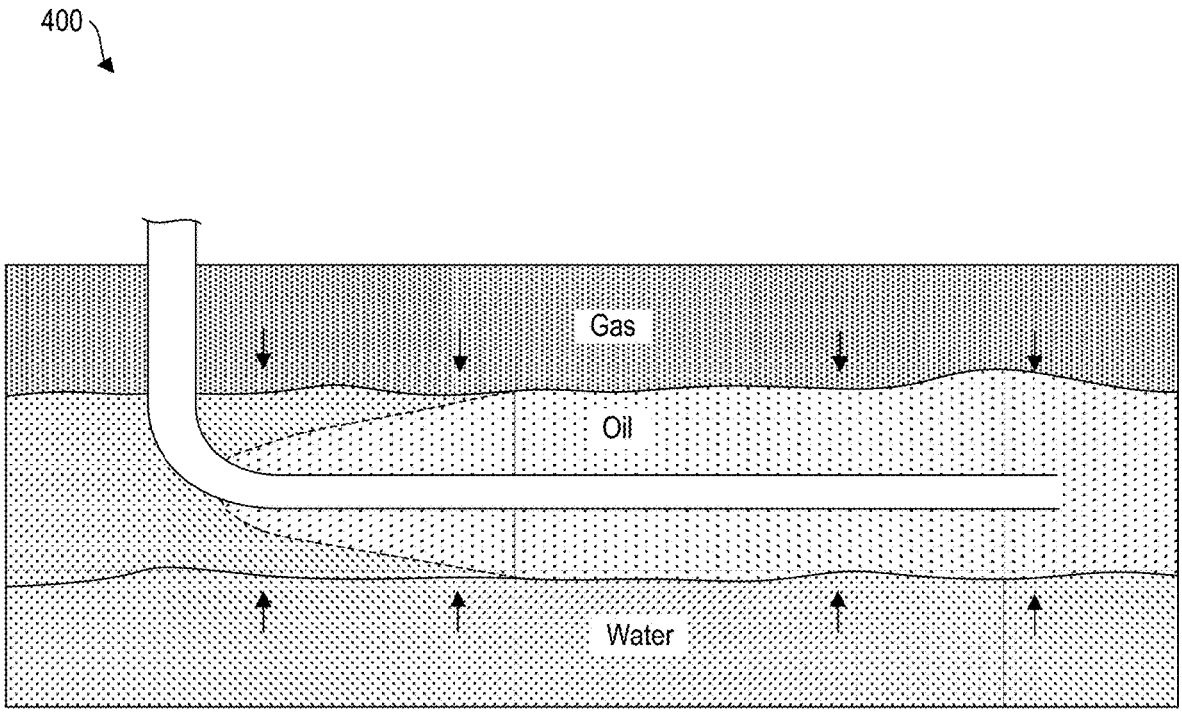
FIG. 4 is a diagram illustrating water and/or gas coning in a lateral well with homogenous reservoir quality.

FIG. 4 is a diagram 400 illustrating water and/or gas coning in a lateral well with homogenous reservoir quality. For example, a homogenous reservoir quality can maximize production at the heel of the reservoir and minimize production at the toe of the reservoir. This can result in, for example, early gas and/or water breakthrough by coning at the heel. Reservoir heterogeneities can be associated with an unequal reservoir depletion along a lateral well, which can be compensated by the implementation of flow restrictions, such as inflow devices, for different zones of the well.

Figure 5:
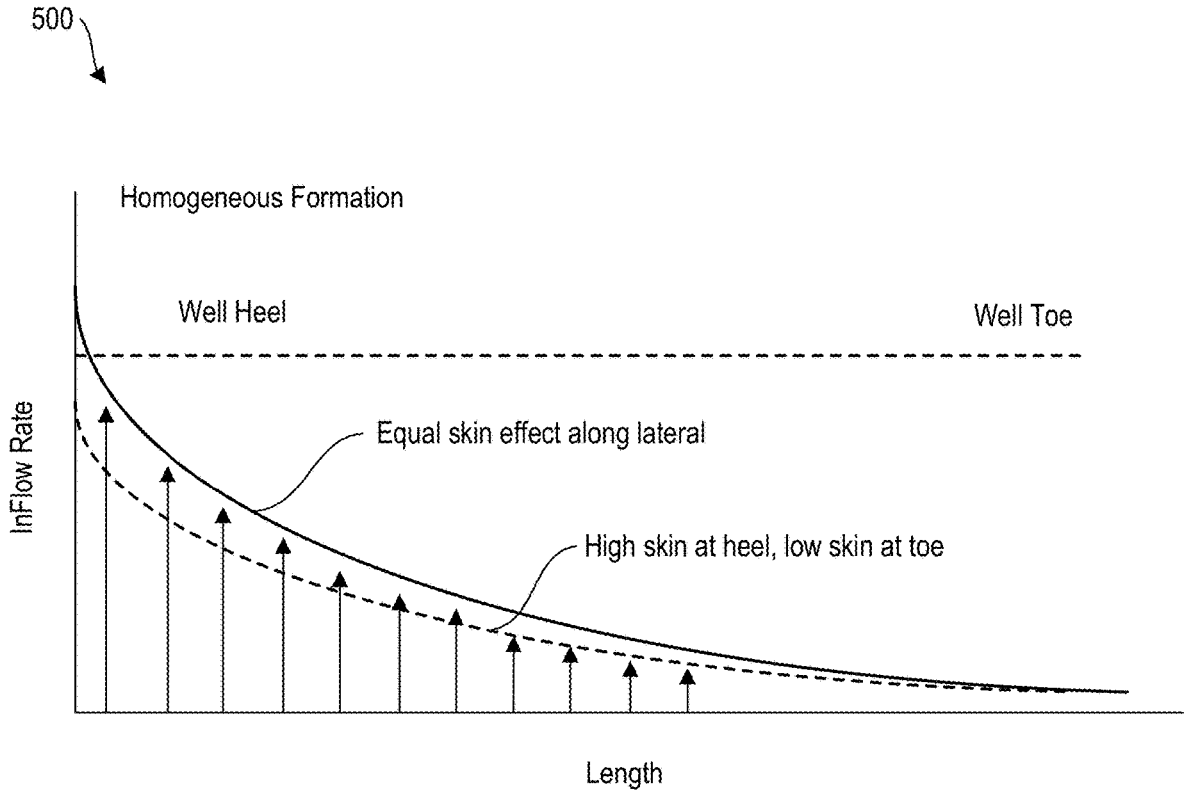
FIG. 5 is a diagram illustrating uncertainty associated with production from laterals.

FIG. 5 is a diagram 500 illustrating uncertainty associated with production from laterals. For example, reservoir damage (e.g., skin) due to drilling, completion and/or displacement fluids, and/or the like, can result in a high skin near the wellbore. One indicator for the skin effect can include time since drilled and, in some cases, the inflow rate can be equally reduced across the well. Additionally, evaluating well production, for example, by history matching actual production data of a reservoir, field, wellbore, and/or the like against a dynamic model of the reservoir, field, wellbore, and/or the like. The value and optimization potential of a wellbore, for example, including navigation and completion can be uncovered after some time and poor history matching can be common.

Figure 6:
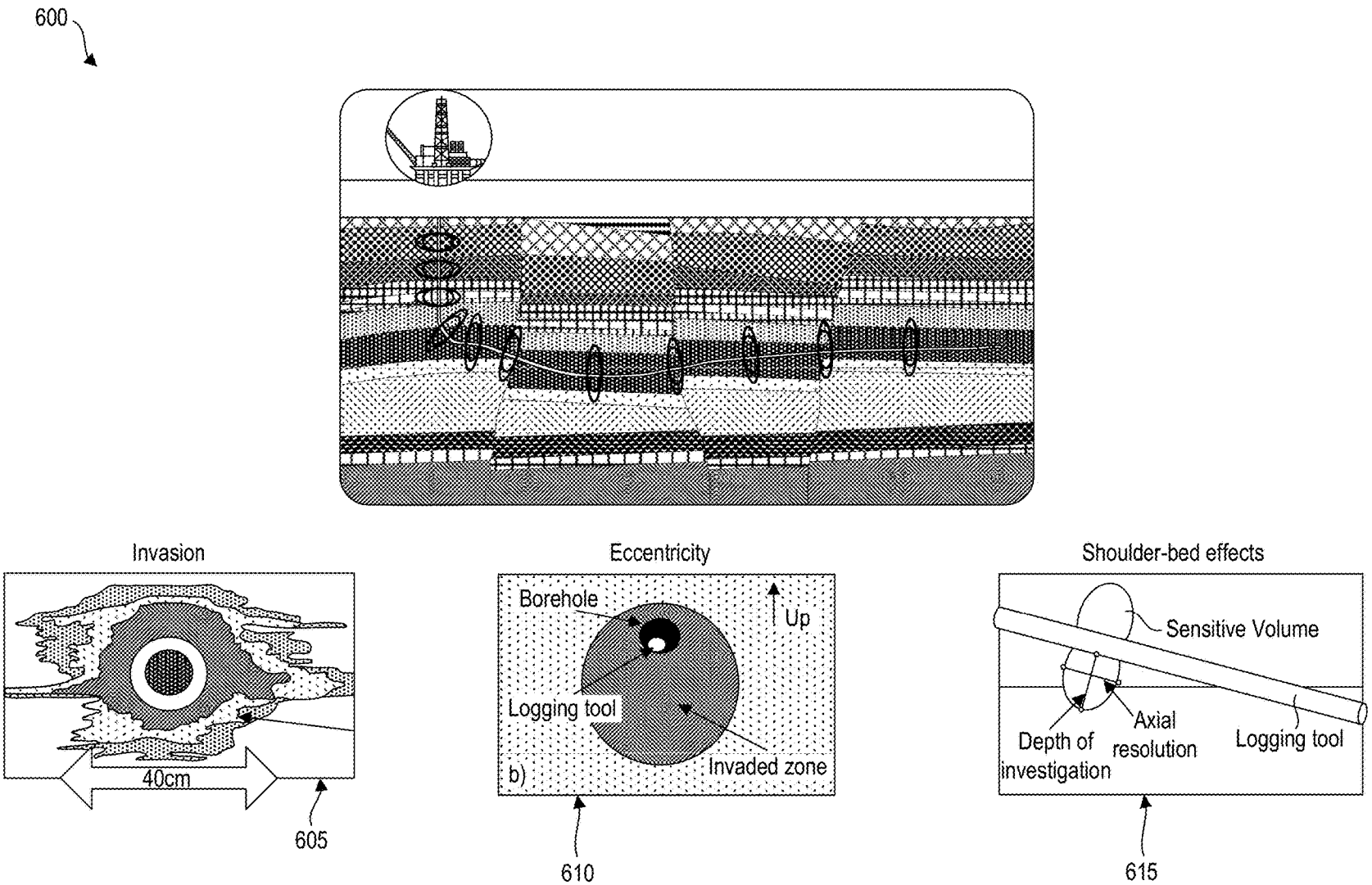
FIG. 6 is a diagram illustrating an example of root causes for artifacts in a formation evaluation log in highly inclined wellbores.

FIG. 6 is a diagram 600 illustrating an example of root causes for artifacts in a formation evaluation log in highly inclined wellbores. In some cases, the root causes can include non-symmetric mud invasion as shown in 605, eccentricity of the logging equipment as shown in 610, shoulder bed effects as shown in 615, and/or the like. Challenges with inaccurate formation and/or petrophysical properties due to log acquisition in high-angle wells can include uncertain pay zone localization and expected reservoir quality, uncertain saturation height calculations, high uncertainty on production targets, uncertainty in movable versus irreducible hydrocarbon evaluation, and/or the like. Additional challenges can include unclear root causes for high water breakthrough, uncertain reservoir capacity distribution along the well, updated reservoir model from logging while drilling logs, uncertainty in asset reserves, uncertainty in ultimate recovery, and/or the like. Due to the challenges mentioned above, for example, field development can be extended, ultimate recovery can be reduced, increases in operating expenses (e.g., due to water treatment, sand production, excessive electrical submersible pump underload shut-downs, and/or the like), inefficient capital expenditure, and/or the like.

Figure 7:
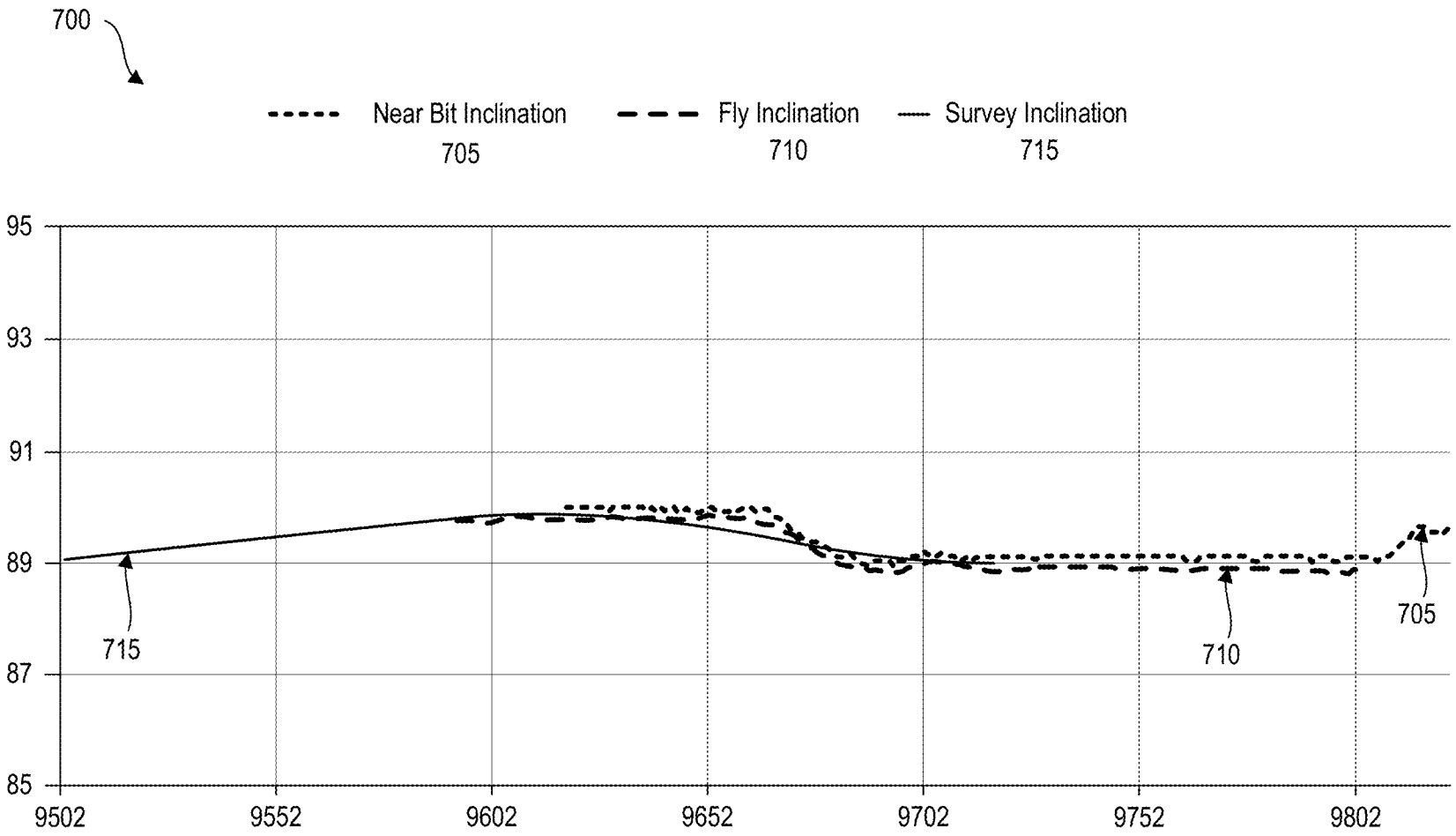
FIG. 7 is a diagram illustrating example differences in well paths from different measurements.

FIG. 7 is a diagram 700 illustrating example differences in well paths (inclinations) from different measurements. The different inclinations can include near-bit inclinations 705, fly inclinations 710, and survey inclinations 715. Hole shale evaluation can include the calculation of dogleg severity (DLS) from a stationary survey. For example, the DLS can be derived in degrees, as shown on the Y-axis per distance, shown on the X-axis. DLS can be calculated over smaller measuring distances from continuous near-bit inclination 705 and/or azimuthal measurements. This can allow providing DLS over a smaller depth interval, for example, degrees per 20 feet. This local dogleg can significantly exceed the stationary dogleg and can provide insight into hole shape and associated consequences.

Figure 8:
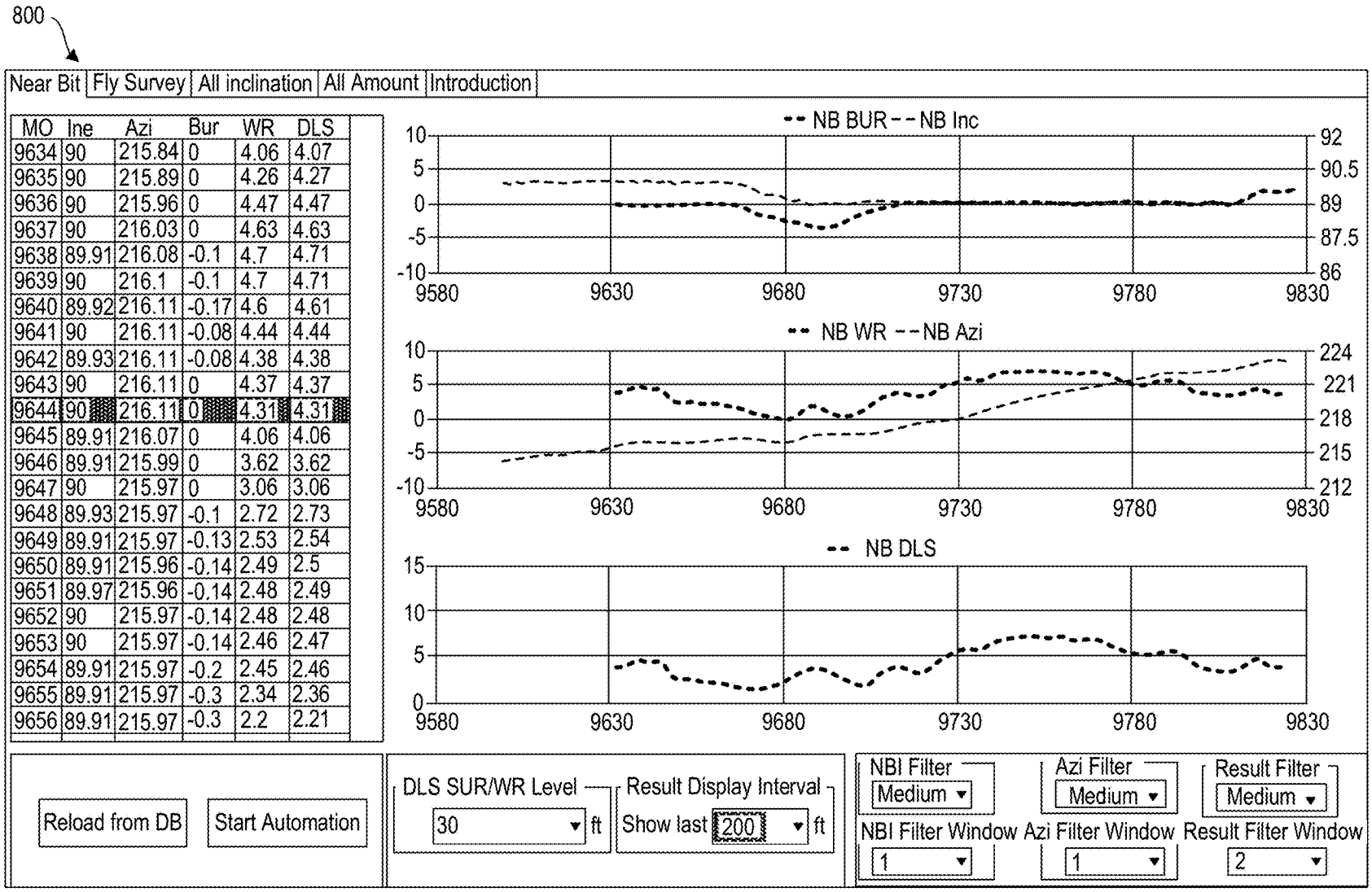
FIG. 8 is a diagram illustrating an example dogleg severity calculation dependent upon the measured depth interval over which dogleg severity is calculated.

FIG. 8 is a diagram 800 illustrating an example DLS calculation dependent upon the measured depth interval over which DLS is calculated. In FIG. 8, for example, DLS can be measured in degrees per a measured depth of 30 feet. In some implementations, DLS can be measured in degrees per a measured depth of 5 feet.

Figure 9:
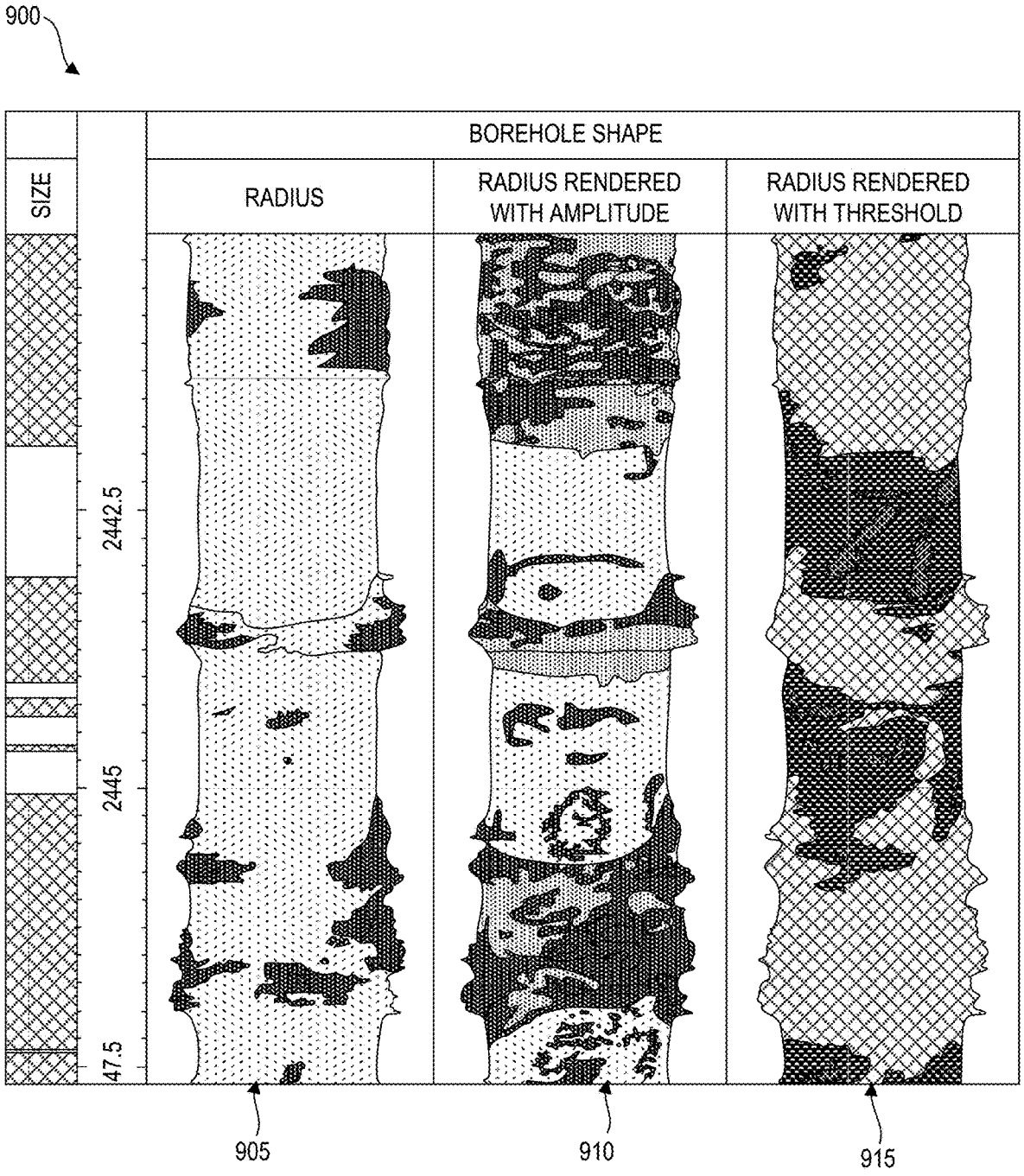
FIG. 9 is a diagram illustrating an ultrasonic caliper log.

FIG. 9 is a diagram 900 illustrating three plots of an ultrasonic caliper log. Ultrasonic imaging can be used, for example, to characterize the shape of a wellbore. Referring to FIG. 9, for example in plot 905, the radius of the borehole can be rendered. In some embodiments, the radius can be rendered with amplitude as shown in plot 910. In some embodiments, the radius can be rendered with threshold, as shown in plots 915.

Figure 10A:
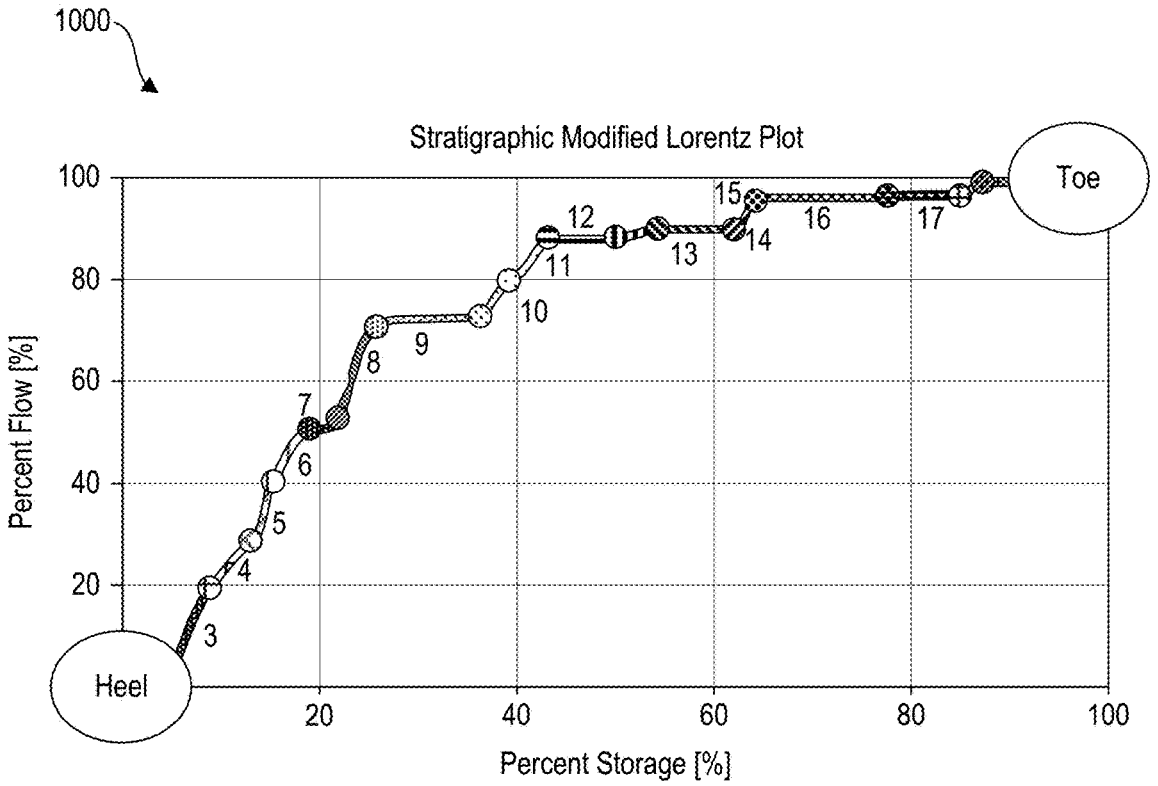
FIG. 10A is a diagram illustrating an example Stratigraphic Modified Lorenz Plot (SMLP)
Figure 10B:
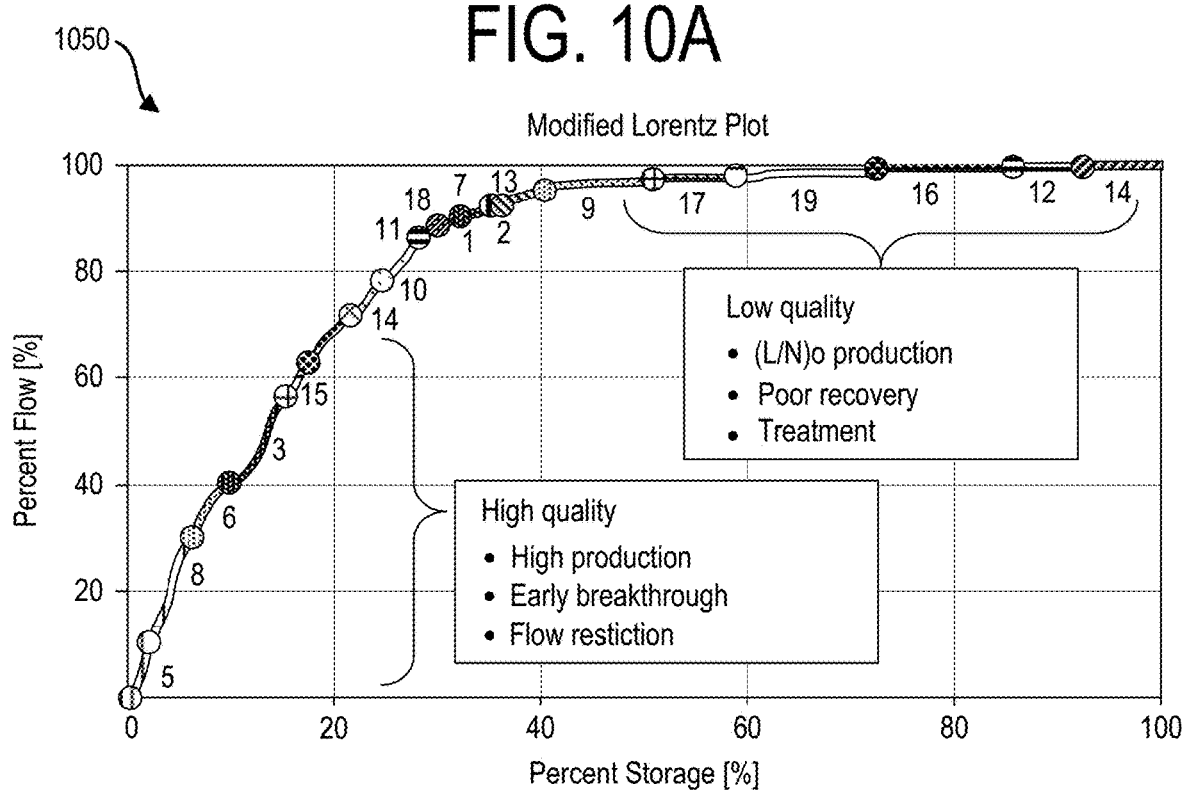
FIG. 10B is a diagram illustrating an example Modified Lorenz Plot (MLP)

In some implementations, reservoir quality can be evaluated by evaluating flow, storage, and/or the like potential along a lateral well. FIG. 10A is a diagram 1000 illustrating an example Stratigraphic Modified Lorenz Plot (SMLP) for evaluating reservoir quality and FIG. 10B is a diagram 1050 illustrating an example Modified Lorenz Plot (MLP). In some cases, given a measured depth z, a porosity $\Phi$, and a permeability K, storage can be determined in the following way:

$$\text{storage}\ (z_m) = \frac{\sum_{i=1}^{m} \Phi_i (z_i - z_{i-1})}{\sum_{j=1}^{N} \Phi_j (z_j - z_{j-1})},$$

for 1, . . . , m, . . . N. Similarly, flow can be determined in the following way:

$$\text{flow}\ (z_m) = \frac{\sum_{i=1}^{m} K_i (z_i - z_{i-1})}{\sum_{j=1}^{N} K_j (z_j - z_{j-1})},$$

for 1, . . . , m, . . . N. The resulting plots can extend from the heel (e.g., $z_1$) to the toe (e.g., $z_N$) and can represent an accumulated percentage of storage (e.g., along the horizontal axis) and accumulated percentage of flow (e.g., along the vertical axis). In a homogenous reservoir along a lateral, for example, the resulting SLMP can include a shape similar to the plot in FIG. 5.

The plots illustrated in FIGS. 10A and 10B can help to identify reservoir and/or formation zones with different storage and/or flow capacities, for example, at inflection points along the graph. For example, FIG. 10A includes 18 zones. Each zone can be associated with a slope. The steeper the slope of a zone, for example, the higher the productivity (e.g., flow) of that particular zone along the lateral. Sorting the zones of the SLMP, illustrated in FIG. 10A, by decreasing slope can result in the MLP illustrated in FIG. 10B. As illustrated in FIG. 10B, the MLP can provide an overview of which zones can be highly productive zones and which zones are less productive. For example, zones 5, 8, 6, and 3 can likely include the highest productivity. However, 18% of the hydrocarbons stored in the lateral (e.g., corresponding to the storage capacity of zones 5, 8, 6, and 3), for example, can be produced without special well treatment.

Figure 11:
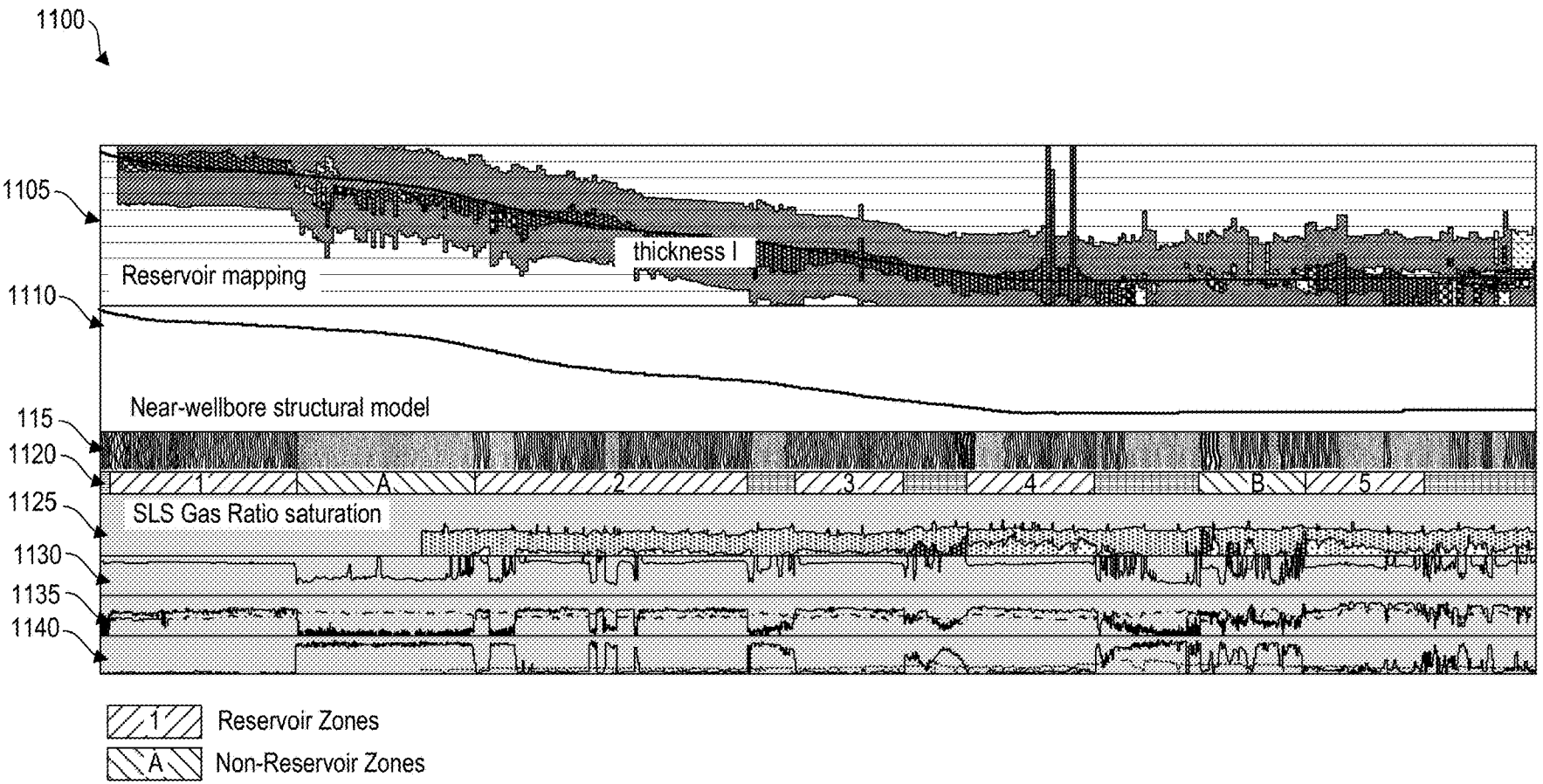
FIG. 11 is a diagram illustrating an example reservoir mapping and associated formation evaluation logs.

In a profit oriented well completion strategy, for example, either the entire well, or the most productive zones are completed. The hydrocarbons in the less productive zones, for example, can be left unproduced. In a recovery oriented well completion strategy, for example, the less productive zones can be completed prior to connecting zones with higher expected productive zones. In some cases, the less productive zones can be acidized, hydraulically stimulated, initially connected to production, and/or the like. Later (e.g., years later), the more productive zones can be connected in addition to and/or in replacement of the less productive zones. The evaluation of storage capacity potential along a lateral well can be extended, for example, using reservoir mapping as illustrated in FIG. 11. By using a thickness, th, of the drilled reservoir determined from the reservoir map, a distance-to-bed calculation, image interpretation, another source, and/or the like, storage can be determined as follows:

$$\text{storage}\ (z_m) = \frac{\sum_{i=1}^{m} \Phi_i th_i (z_i - z_{i-1})}{\sum_{j=1}^{N} \Phi_j th_j (z_j - z_{j-1})},$$

for 1, . . . , m, . . . N.

FIG. 11 is a diagram 1100 illustrating an example reservoir mapping and associated formation evaluation logs, gas ratio analysis, and/or the like. The reservoir can be delineated and the delineation can include mapping caprock boundaries, fluid contacts, and/or the like. FIG. 11 can provide a visualization of a combined interpretation of a reservoir. The uppermost track (e.g., track 1105), for example, can include a curtain section containing the actual well trajectory and an inversion result of deep-reading electromagnetic logging data. For example, the thickness of the lateral well can be determined from the uppermost track. The second track (e.g., track 1110), for example, can include a near-wellbore structural model which can be derived from bed boundaries that were identified on borehole images in the third track (e.g., track 1115). An image in this context, for example, can include an azimuthal representation of a physical property of the measured formation and can include an azimuthal electrical measurement, an azimuthal gamma ray measurement, and/or the like. The fourth track (e.g., track 1120), for example, can highlight a zonation of properties along the lateral well, with a zonation including a depth interval which can be considered a section of a subsurface formation with average formation properties. Zones can be automatically identified, for example, using artificial intelligence algorithms to analyze formation evaluation logs such as measurements of gamma ray, density, neutron, resistivity, and/or the like.

In some implementations, the FIG. 11 can be used to define zones using an appropriate user interface to the system. Reservoir zones (e.g., 1, 2, 3, 4, 5, and/or the like) and non-reservoir zones (e.g., A, B, and/or the like) can be defined. Also, zones may not be defined at intervals along the lateral well where, for example, the well trajectory does not intersect a reservoir. The fifth track (e.g., track 1125), for example, can include an interpretation of surface logging data, such as a total porosity (e.g., the shaded volume shown in track 1125), a hydrocarbon porosity color-coded area, a likely hydrocarbon type (e.g., represented by spikes within the shaded volume shown in track 1125), and/or the like. Data used from surface logging equipment can be total gas, the concentrations of hydrocarbon components (e.g., C1-C5), and/or the like. Interpretation methods, such as gas ratio analysis, can be used to derive such logs. FIG. 11 can further include, for example, measures of resistivity (e.g., in track 1130), neutron-density logs (e.g., track 1135), a gamma ray track (e.g., track 1140), and/or the like. Track 1140 can also include a rate-of-penetration (ROP).

In some implementations, the inversion results can be composed of a number of vertical profiles along the lateral well. For example, each profile can include at least one formation layer with at least one formation property, such as horizontal or vertical resistivity, formation dip, and/or the like. Formation resistivity, for example, can include an outcome of the inversion, can require electromagnetic signals from the deep-reading measurements, can include phase difference and/or attenuation in degree and/or decibel, apparent resistivity values (e.g., in ohmm), electrical conductivities (e.g., in siemens), and/or the like. The alignment of these 1-dimensional profiles along the well can provide a visualization of the reservoir extent and structure, which can be referred to as a reservoir map. For example, a reservoir can be constrained by a caprock with low resistivity (e.g., shale caprock as a rock boundary) at the top as the maximum upper extent. As another example, the reservoir can extend to a fluid contact (e.g., a fluid boundary), such as an oil-gas contact above an oil-bearing zone or an oil-water contact below an oil-bearing zone.

Reservoir thickness can include, for example, the distance between the well trajectory and the nearest formation boundary with a large resistivity contrast. In some cases, the reservoir can be defined as a formation layer which can be attributed by a resistivity value above a certain threshold (e.g., above a threshold of 100 ohm). Storage (e.g., when using thickness and porosity) can be defined for formation layers containing the well trajectory and including a resistivity above the threshold. Accordingly, non-reservoir layers (e.g., non-pay zones), for example, can be excluded from the calculation, since they may not contribute to the storage potential of hydrocarbons along the lateral well. Other deep-reading logging technologies can be within the scope of the current disclosure, and can be used, for example, to delineate the structure, extent, and/or the like of a reservoir. Such as, for example, acoustic wave imaging (e.g., the reflection of an acoustic wave at a structure with sufficiently large acoustic impedance contrast can serve as a means to delineate rock and/or fluid boundaries), transient electromagnetic measurements, seismic while drilling measurements, electromagnetic measurements, and/or the like.

In some implementations, zones defined in the curtain section can be linked to the SMLP, MLP, and/or the like, for example, such that zones defined on the curtain track can be populated to the SMLP, MLP, and/or the like. The manipulation of a zone (e.g., automatic, manual, and/or the like), for example, in one visualization can affect the zones in a different visualization. Whereas a SMLP can include zones for reservoir sections and non-reservoir sections (e.g., non-pay zones), for example, reservoir sections can be used to compare zones using the sorting of flow and/or storage capacity in the MLP. In some cases, a MLP can exclude non-reservoir sections (e.g., non-pay zones), which can be useful when a sequence of sand channels, for example, can be penetrated by a well trajectory, such as a turbidite reservoir. In some implementations, an analyzer, interpreter, and/or the like of the reservoir quality, for example, purposefully exclude particular intervals along the lateral well because a reservoir interval has been water flooded and cannot be connected to the wellbore.

Figure 12A:
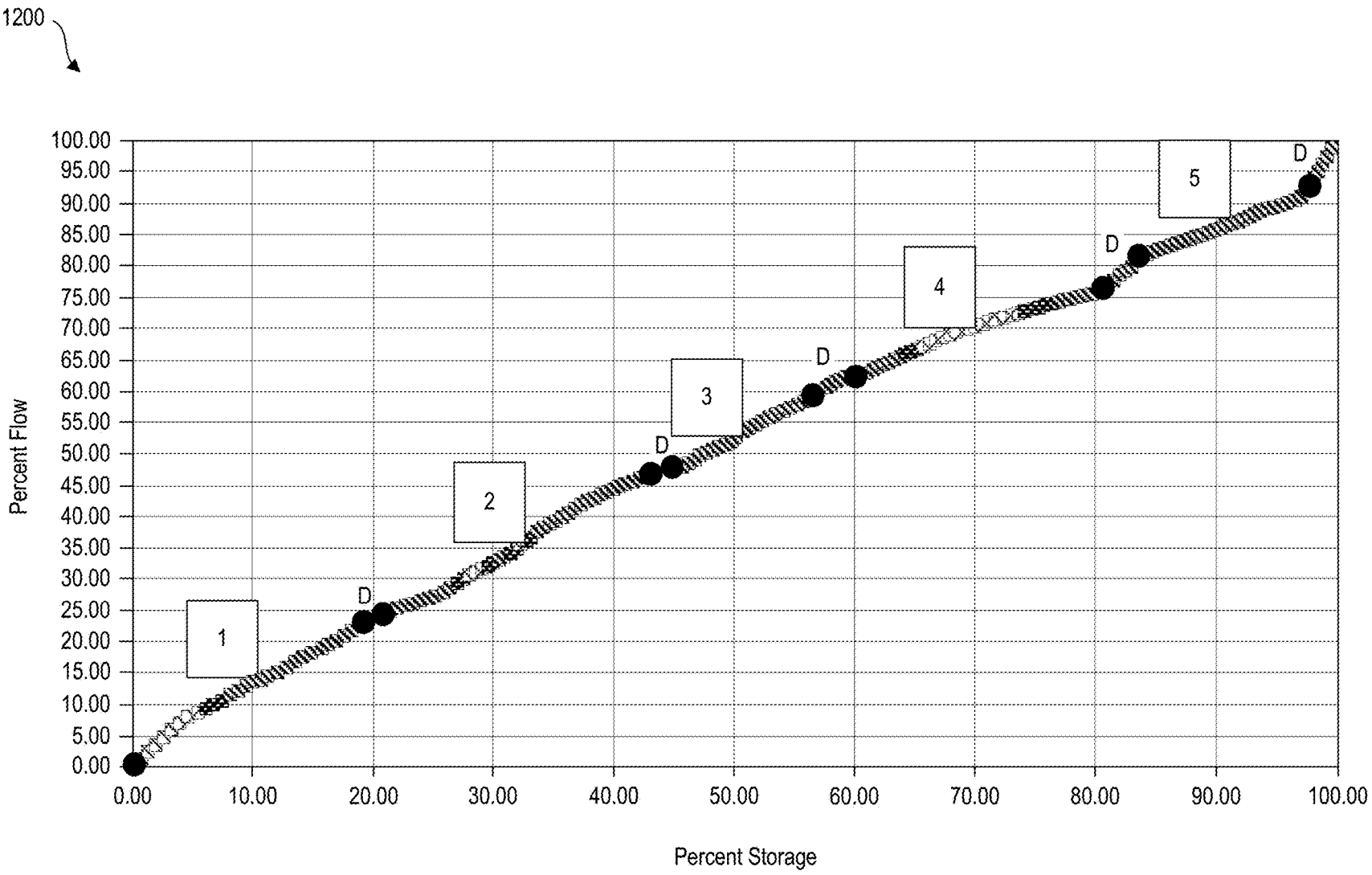
FIG. 12A is a diagram illustrating an example of the 2-dimensional evaluation of storage potential along the lateral.
Figure 12B:
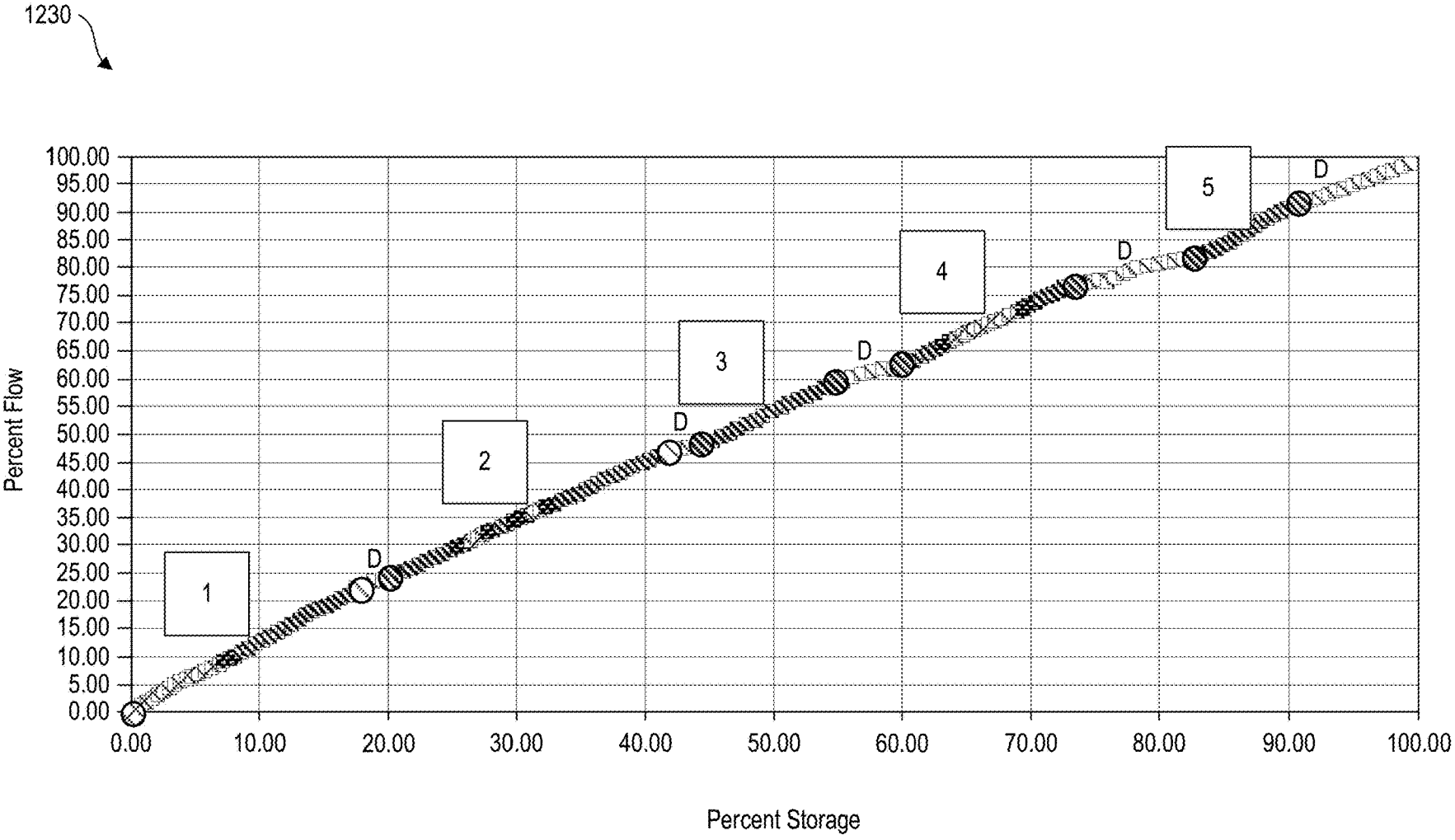
FIG. 12B is a diagram illustrating an example of the evaluation of storage potential along the lateral using the porosity equation.\.
Figure 12C:
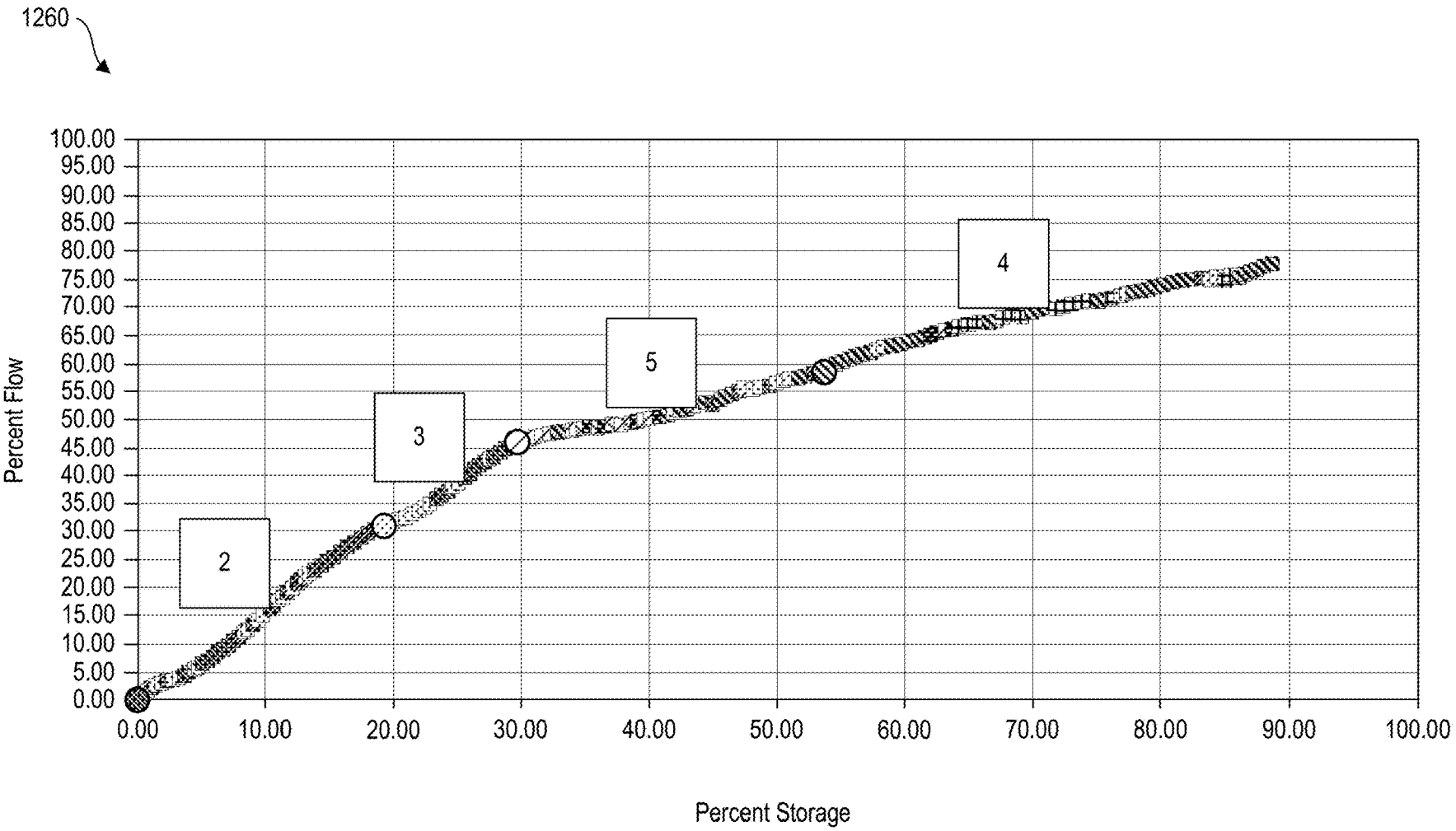
FIG. 12C is a diagram illustrating an example 2-dimensional evaluation of storage potential along the lateral including multiplying the hydrocarbon saturation.

In some implementations, it can be possible to evaluate 2-dimensional storage capacity along a lateral. FIG. 12A-C are diagrams illustrating evaluation of storage potential along the lateral. FIG. 12A is a diagram 1200 illustrating an example of the 2-dimensional evaluation of storage potential along the lateral. FIG. 12B is a diagram 1230 illustrating an example of the evaluation of storage potential along the lateral using the porosity equation. FIG. 12C is a diagram 1260 illustrating an example 2-dimensional evaluation of storage potential along the lateral including multiplying the hydrocarbon saturation. In some cases, such as cases with equal water saturation along the lateral, the 2-dimensional method can provide a more accurate estimate of storage potential around a lateral well. For example, zone 4 can contribute 21% hydrocarbon volume to the wellbore in FIG. 12C as opposed to 15% in FIG. 12B. For cases with unequal water saturation, for example, the storage potential equation can be modified to account for saturation, S, and can provide an alternative storage capacity evaluation along a lateral well, where, $$\text{storage}\ (z_m) = \frac{\sum_{i=1}^{m} \Phi_i S_{HC} th_i (z_i - z_{i-1})}{\sum_{j=1}^{N} \Phi_j S_{HC} th_j (z_j - z_{j-1})},$$

for 1, . . . , m, . . . N.

Table 1 can illustrate an example comparison of the storage capacity evaluations described above, where, depending on the method of evaluation used, the hydrocarbons in place can vary by a significant amount.

TABLE 1

| Zone | % storage - Porosity | % storage - Porosity* thickness | % storage - Porosity* thickness*$S_{hc}$ |
|---|---|---|---|
| 1 | 24.6 | 21.6 | — |
| 2 | 31.5 | 27.2 | 21.6 |
| 3 | 13.7 | 12.5 | 12.5 |
| 4 | 19.2 | 22.7 | 38.6 |
| 5 | 11 | 16 | 27.3 |

In some cases, formation evaluation logs acquired in high-angle wells can experience a number of effects attributed to, for example, the environmental conditions of the borehole geometry. The borehole conditions can be different from environmental conditions for wireline formation evaluation logs. For example, invasion effects can be non-symmetrical and the vertical well assumption of being radially symmetrical may not apply for logging while drilling logs; bottom-hole assembly containing the logging while drilling equipment may not be concentrically positioned inside the borehole such that eccentricity effects can be observed on logging while drilling logs; shoulder-bed effects can be relevant when formation boundaries can be penetrated and logged at low angles of incidence because the volume of the formation measurements contain responses from multiple formations including different properties; and/or the like.

Figure 13:
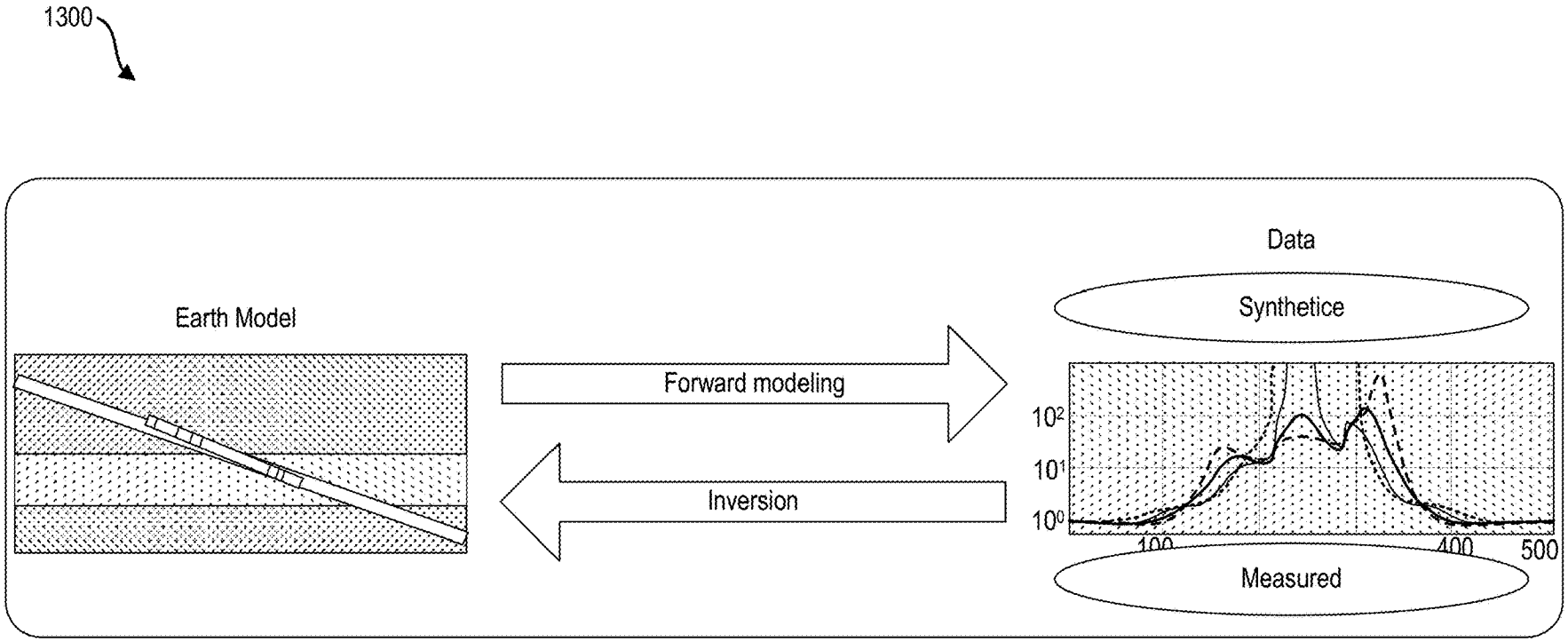
FIG. 13 is a diagram illustrating an example approach to formation response modelling.

FIG. 13 is a diagram 1300 illustrating an example approach to formation response modelling. Forward modelling can include calculating synthetic logs physically read by a logging tool in a given, user-defined model of the Earth (e.g., a digital representation of the environment around the borehole). The forward modeling solver can represent the physical principles of the tool sensor. The synthetic logs can be compared against the actual measurements and a coincidence between them can provide an Earth model capable of, for example, explaining the measured logs. If synthetic and measured logs do not coincide, the Earth model can be altered (e.g., layer positions changed) until coincidence can be achieved. An inversion process automatically adjusts the Earth model until an accurate match between synthetic and/or measured logs can be achieved. A resulting Earth model can, for example, describe the formation properties around the wellbore and can be used for further petrophysical analysis to derive porosities, saturations, volumetrics, and/or the like.

Figure 14:
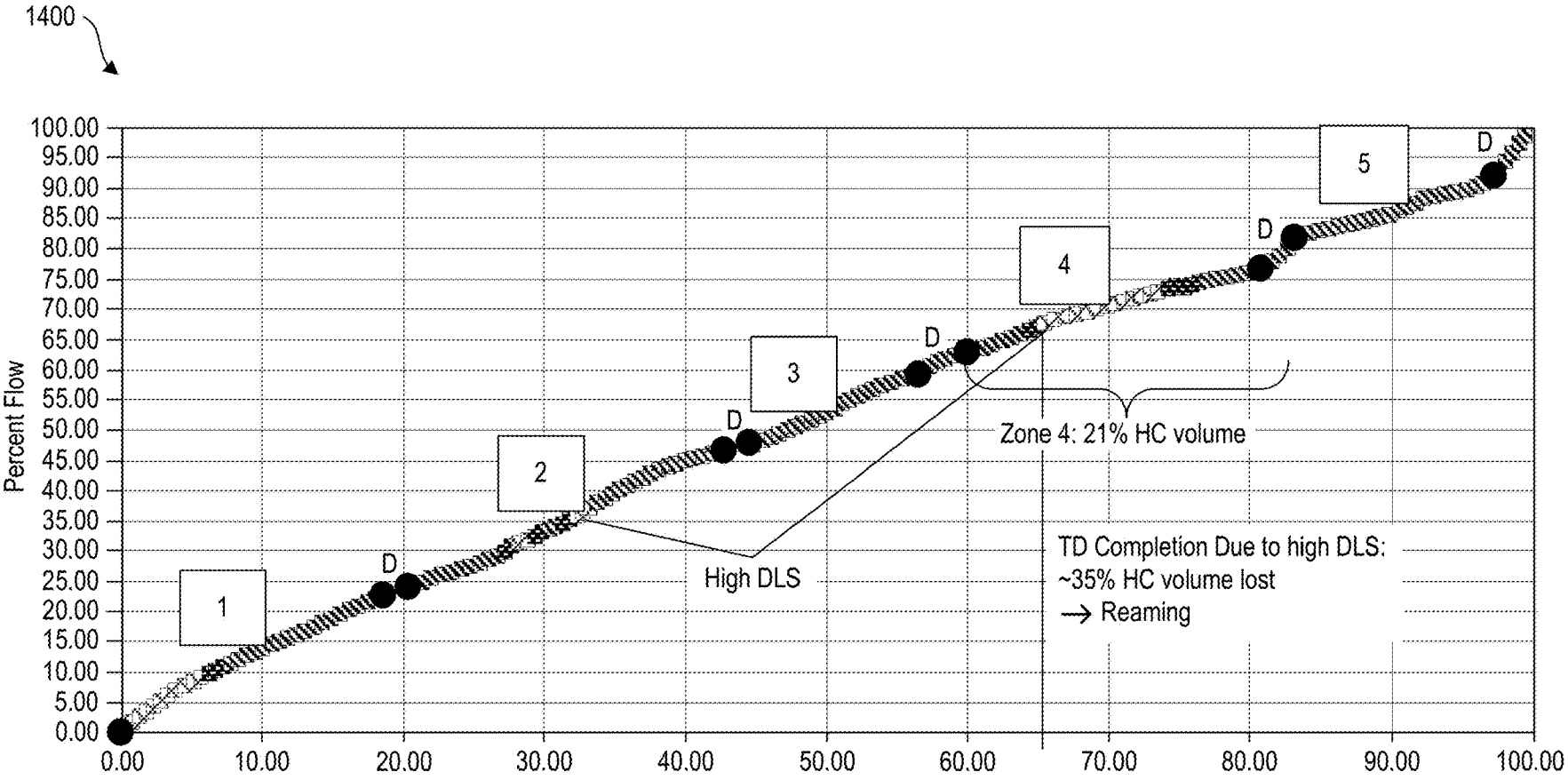
FIG. 14 is a diagram illustrating an example plot including the effect of completion challenges on production losses.

In some implementations, production risk by completion challenges can be evaluated by color coding the SMLP by a hole shape indicator. FIG. 14 is a diagram 1400 illustrating an example plot including the effect of completion challenges on production losses. For example, zones 1, 2, and 4 of FIG. 14 include higher dogleg severity. This can provide insight into the consequences associated with completion challenges. For example, if high dogleg severity causes the completion string to be stuck at the beginning of zone 4 (e.g., indicated by the vertical line), ~35% of the hydrocarbon volume may not be connected to the wellbore. For this amount of hydrocarbon, a decision can be made, for example, to ream the well and rerun the casing.

Figure 15:
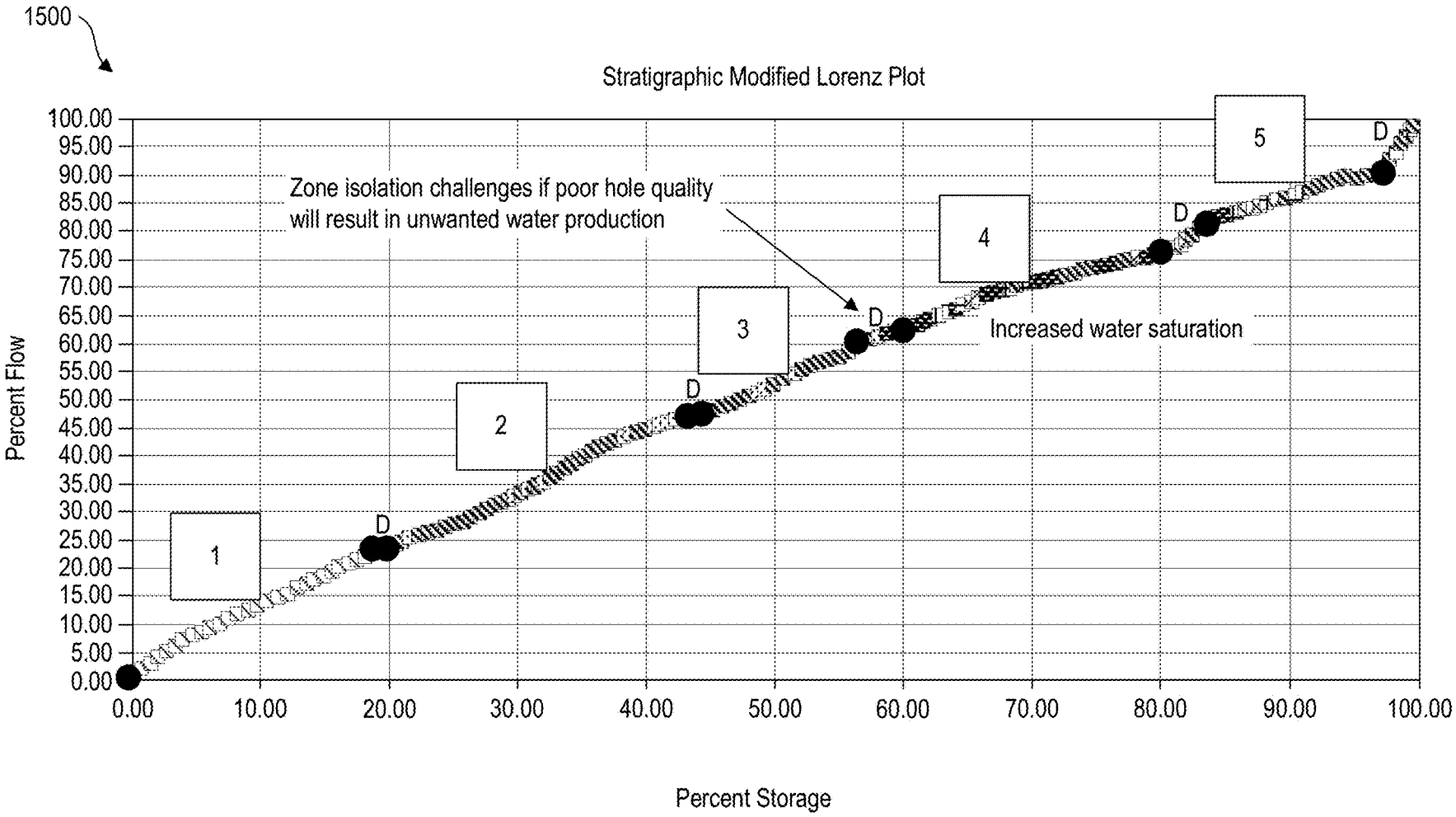
FIG. 15 is a diagram illustrating an example plot including the evaluation of zone isolation risk and consequences.

In some implementations, the consequences of zone isolation challenges can be analyzed using the SMLP with respect to the saturation of water. FIG. 15 is a diagram 1500 illustrating an example plot including the evaluation of zone isolation risk and consequences. For example, zone 4 and the beginning of zone 5 can include an increased water saturation and can provide a reason to isolate zones 1-3 from zones 4 and 5. Hole shape induced cementation challenges in between zones 3 and 4 can be inspected using the above mentioned technique, additional hole shape logs, and/or the like. Depending on the hole shape, a decision can be made, for example, to ream the interval between zones 3 and 4 to ensure cementation.

Figure 16:
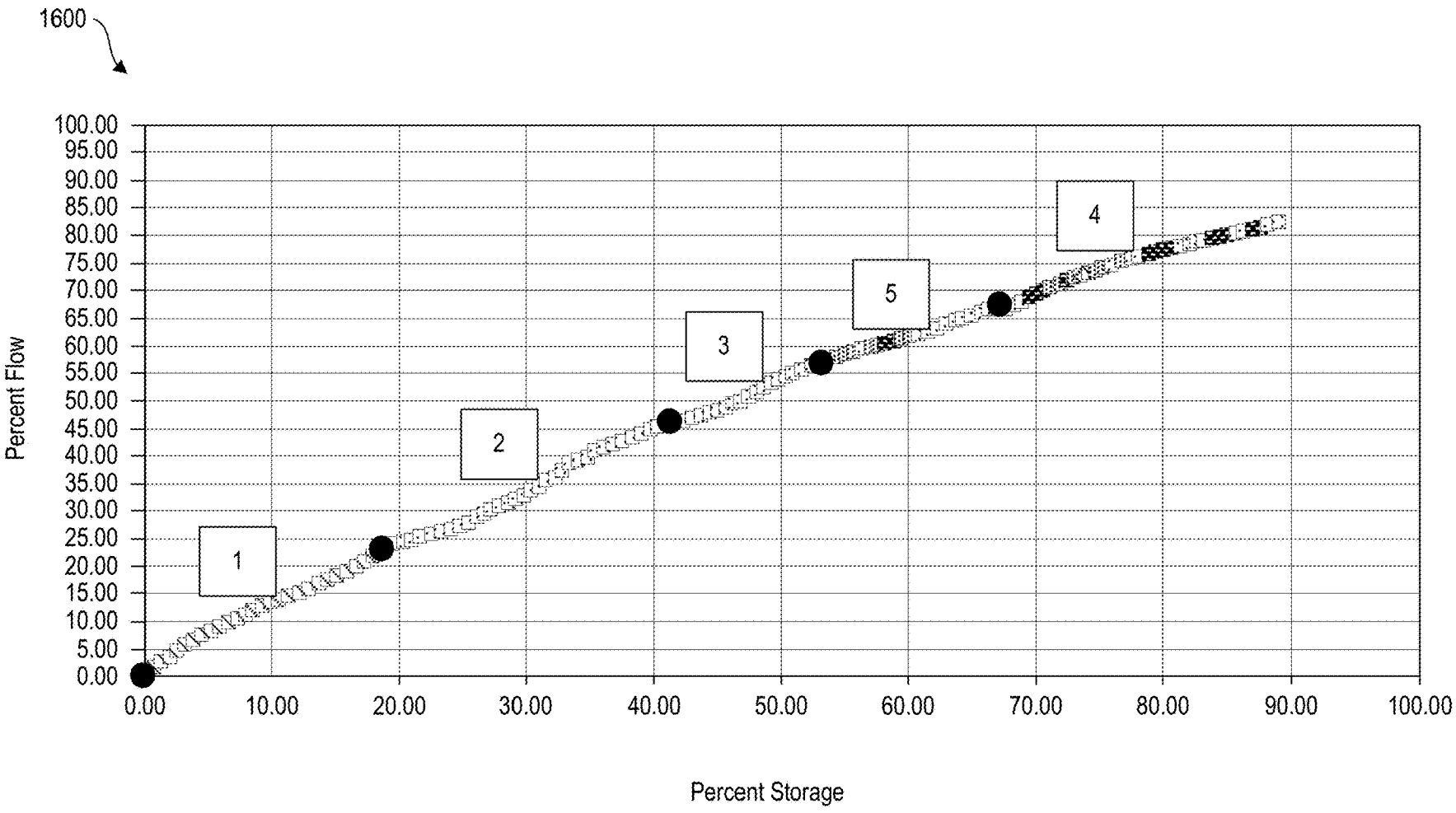
FIG. 16 is a diagram illustrating an example arrangement of flow zones using permeability.
Figure 17:
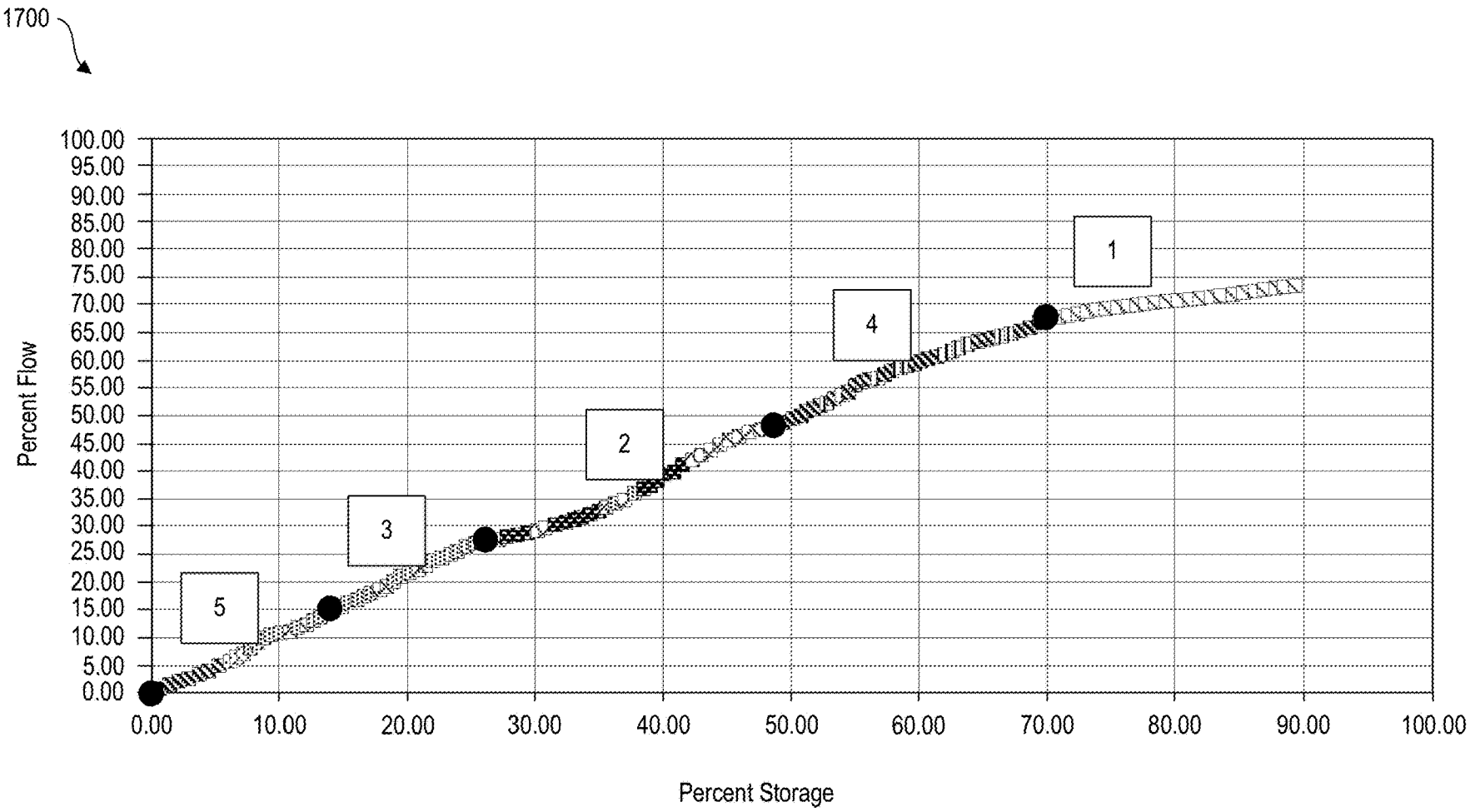
FIG. 17 is a diagram illustrating an example arrangement of flow zones using skin effect.

Similarly, flow potential along the lateral can be advanced by introducing a weight on permeability to account for, for example, near-wellbore skin (e.g., reservoir damage). Then, $$\text{flow}\ (z_m) = \frac{\sum_{i=1}^{m} w_{s,i} K_i (z_i - z_{i-1})}{\sum_{j=1}^{N} w_{s,j} K_j (z_j - z_{j-1})},$$

for 1, . . . , m, . . . N, with $w_s$ the weight on permeability representing the skin effect on the flow along the lateral. Depending on the skin, the flow potential of the zones can be arranged differently such that treatment of the wellbore can be necessary to optimize production and/or recovery from the well. FIG. 16 is a diagram 1600 illustrating an example arrangement of flow zones using permeability. FIG. 17 is a diagram 1700 illustrating an example arrangement of flow zones using skin effect.

In some implementations of the current subject matter, well construction can be optimized at minimum risk. For example, indicators of production performance can be verified and adjusted in real-time and quick customer decisions can be made within a short time frame and across multiple persona. For example, some implementations of the current subject matter can support a petrophysicist and/or operation geologist to discuss and justify an interpretation of a logging while drilling logs in front of reservoir, completion, and/or production engineers and/or the like. Depending on a depletion strategy (e.g., profit oriented, recovery oriented, and/or the like), the team can make decisions on drilling and completion operations.

Some implementations of the current subject matter can apply to lateral wells, wellbore positioning, and/or wellbore navigation towards production-optimized well construction. For example, the amount of hydrocarbons stored along and away from a lateral well which the drilled wellbore is penetrating can be evaluated. As another example, the producibility along a lateral well can be evaluated based on a permeability (index) log, formation testing mobility and/or fluid typing, and/or the like. As another example, the risk associated with completing the lateral well can be evaluated using hole shape analysis from near-bit azimuth and inclination, ultrasonic caliper and hole shape logs and images, sanding risk analysis, and/or the like. As another example, the capital expenditure needed to complete a well, the operating expense during production from the lateral, the profit gained from producing the hydrocarbon, and/or the like can be evaluated.

Exemplary technical effects of the methods, systems, and computer-readable medium described herein include, by way of non-limiting example, determining a well construction plan based on a wellbore storage capacity and a wellbore flow capacity. The well construction plan can allow wellbore operators to select suitable equipment to achieve the highest production rates from the well. For example, depending on the relative flow capacities of the reservoir zones, the flow restriction caused by the inflow control devices (ICD) can be re-evaluated and appropriate ICD equipment can be chosen. In addition, the position of the ICDs (location in MD along a producing borehole) can be selected.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to as programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example as would a processor cache or other random access memory associated with one or more physical processor cores.

To provide for interaction with a user, one or more aspects or features of the subject matter described herein can be implemented on a computer having a display device, such as for example a cathode ray tube (CRT) or a liquid crystal display (LCD) or a light emitting diode (LED) monitor for displaying information to the user and a keyboard and a pointing device, such as for example a mouse or a trackball, by which the user may provide input to the computer. Other kinds of devices can be used to provide for interaction with a user as well. For example, feedback provided to the user can be any form of sensory feedback, such as for example visual feedback, auditory feedback, or tactile feedback; and input from the user may be received in any form, including acoustic, speech, or tactile input. Other possible input devices include touch screens or other touch-sensitive devices such as single or multi-point resistive or capacitive trackpads, voice recognition hardware and software, optical scanners, optical pointers, digital image capture devices and associated interpretation software, and the like.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." In addition, use of the term "based on," above and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results. Other implementations may be within the scope of the following claims.

What is claimed is:

1. A method comprising:

receiving data characterizing measurements recorded while drilling a wellbore into a reservoir including hydrocarbons within a plurality of zones of the reservoir;

determining, using the measurements and a reservoir map, a storage capacity of the wellbore and a flow capacity of the wellbore;

determining a thickness of the reservoir using the reservoir map;

determining, using the storage capacity and the flow capacity, a well construction plan identifying an ordered arrangement for recovering hydrocarbons from each of the plurality of zones of the reservoir, wherein the ordered arrangement identifies recovering hydrocarbons from a first zone of the reservoir prior to recovering hydrocarbons from a second zone of the reservoir, the first zone including a lower flow capacity than the second zone; and providing the well construction plan for display in a visualization of the reservoir map, the displayed well construction plan including a well trajectory displayed in a curtain section of the reservoir, the curtain section determined based on the thickness of the reservoir.

2. The method of claim 1, wherein determining the well construction plan further comprises:

determining, using the flow capacity, a first placement location for an inflow control device; and wherein providing the well construction plan further comprises:

providing, within a graphical user interface display space, the first placement location.

3. The method of claim 1, wherein the measurements include a hole quality measurement, and determining the well construction plan further comprises:

determining, using the hole quality measurement, a second placement location for a packer; and wherein providing the well construction plan further comprises:

providing, within a graphical user interface display space, the second placement location.

4. The method of claim 1, further comprising:

plotting the flow capacity as a function of the storage capacity;

determining a first zone of the plot and a second zone of the plot, the first zone of the plot including a first portion of the plot with a first slope, and the second zone of the plot including a second portion of the plot with a second slope;

sorting, using the first slope and the second slope, the first zone of the plot and the second zone of the plot;

providing, in a graphical user interface display space, the sorted first zone and the sorted second zone.

5. The method of claim 4, wherein the first slope characterizes the first zone of the plot with a first quality representing satisfactory production, early breakthrough, and/or flow restriction.

6. The method of claim 5, further comprising:

receiving data characterizing a first slope threshold value;

comparing the first slope to the first slope threshold value, and determining the first zone of the plot is characterized by a first quality;

providing, within the graphical user interface display space, the characterization of the first zone of the plot with the first quality.

7. The method of claim 4, wherein the second slope characterizes the second zone of the plot with a second quality representing a zone requiring a treatment.

8. The method of claim 7, wherein the treatment includes stimulation of the second zone of the plot, cementation of the second zone of the plot, and/or isolation of the second zone of the plot.

9. The method of claim 4, wherein the plot includes a stratigraphic modified Lorenz plot and/or an associated modified Lorenz plot.

10. The method of claim 1, further comprising:

providing, within a graphical user interface display space an image of fractures around the wellbore.

11. The method of claim 10, wherein the image of fractures around the wellbore further includes at least one of a density, a resistivity, a gamma ray, or an acoustic impedance.

12. The method of claim 1, wherein the well construction plan includes wellbore positioning data and wellbore navigation data.

13. A system comprising:

at least one data processor; and a memory storing instructions, which when executed by the at least one data processor causes the at least one data processor to perform operations comprising:

receiving data characterizing measurements recorded while drilling a wellbore into a reservoir including hydrocarbons within a plurality of zones of the reservoir;

determining, using the measurements and a reservoir map, a storage capacity of the wellbore and a flow capacity of the wellbore;

determining a thickness of the reservoir using the reservoir map;

determining, using the storage capacity and the flow capacity, a well construction plan identifying an ordered arrangement for recovering hydrocarbons from each of the plurality of zones of the reservoir, wherein the ordered arrangement identifies recovering hydrocarbons from a first zone of the reservoir prior to recovering hydrocarbons from a second zone of the reservoir, the first zone including a lower flow capacity than the second zone; and providing the well construction plan for display in a visualization of the reservoir map, the displayed well construction plan including a well trajectory displayed in a curtain section of the reservoir, the curtain section determined based on the thickness of the reservoir.

14. The system of claim 13, wherein determining the well construction plan further comprises:

determining, using the flow capacity, a first placement location for an inflow control device; and wherein providing the well construction plan further comprises:

providing, within a graphical user interface display space, the first placement location.

15. The system of claim 13, wherein the measurements include a hole quality measurement, and wherein determining the well construction plan further comprises:

determining, using the hole quality measurement, a second placement location for a packer; and wherein providing the well construction plan further comprises:

providing, within a graphical user interface display space, the second placement location.

16. The system of claim 13, wherein the instructions further cause the at least one data processor to perform operations including:

plotting the flow capacity as a function of the storage capacity;

determining a first zone of the plot and a second zone of the plot, the first zone of the plot including a first portion of the plot with a first slope, and the second zone of the plot including a second portion of the plot with a second slope;

sorting, using the first slope and the second slope, the first zone of the plot and the second zone of the plot;

providing, in a graphical user interface display space, the sorted first zone and the sorted second zone.

17. The system of claim 16, wherein the first slope characterizes the first zone of the plot with a first quality representing satisfactory production, early breakthrough, and/or flow restriction.

18. The system of claim 17, wherein the instructions further cause the at least one data processor to perform operations including:

receiving data characterizing a first slope threshold value;

comparing the first slope to the first slope threshold value, and determining the first zone of the plot is characterized by a first quality;

providing, within the graphical user interface display space, the characterization of the first zone of the plot with the first quality.

19. The system of claim 16, wherein the second slope characterizes the second zone of the plot with a second quality representing unsatisfactory production, unsatisfactory recovery, and/or requiring treatment.

20. A non-transitory computer readable medium storing instructions, which when executed by at least one data processor cause the at least one data processor to perform operations comprising:

receiving data characterizing measurements recorded while drilling a wellbore into a reservoir including hydrocarbons within a plurality of zones of the reservoir;

determining, using the measurements and a reservoir map, a storage capacity of the wellbore and a flow capacity of the wellbore;

determining a thickness of the reservoir using the reservoir map;

determining, using the storage capacity and the flow capacity, a well construction plan identifying an ordered arrangement for recovering hydrocarbons from each of the plurality of zones of the reservoir, wherein the ordered arrangement identifies recovering hydrocarbons from a first zone of the reservoir prior to recovering hydrocarbons from a second zone of the reservoir, the first zone including a lower flow capacity than the second zone; and providing the well construction plan for display in a visualization of the reservoir map, the displayed well construction plan including a well trajectory displayed in a curtain section of the reservoir, the curtain section determined based on the thickness of the reservoir.

* * * * *